US009466884B2

(12) United States Patent
Pu et al.

(10) Patent No.: US 9,466,884 B2
(45) Date of Patent: Oct. 11, 2016

(54) CONNECTOR, ANTENNA AND ELECTRONIC DEVICE

(71) Applicant: Industrial Technology Research Institute, Hsinchu (TW)

(72) Inventors: Ta-Chun Pu, Kaohsiung (TW); Hung-Hsuan Lin, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 306 days.

(21) Appl. No.: 14/190,110

(22) Filed: Feb. 26, 2014

(65) Prior Publication Data

US 2015/0085459 A1 Mar. 26, 2015

(30) Foreign Application Priority Data

Sep. 26, 2013 (TW) ..... 102134838 A

(51) Int. Cl.
*H01Q 1/24* (2006.01)
*H01Q 13/06* (2006.01)
*H01Q 1/44* (2006.01)

(52) U.S. Cl.
CPC ..... *H01Q 13/06* (2013.01); *H01Q 1/243* (2013.01); *H01Q 1/44* (2013.01)

(58) Field of Classification Search
CPC ..... H01Q 1/243; H01Q 1/44; H01Q 13/06; H05K 7/06; H05K 1/181; H05K 2201/10098; H05K 2201/10189; H01R 13/665
USPC ..... 343/702, 776, 778, 785, 905; 439/620.21
See application file for complete search history.

(56) References Cited

U.S. PATENT DOCUMENTS 6,417,812 B1 7/2002 Tsai
7,466,289 B2 12/2008 Lin et al.
7,587,228 B2 9/2009 Kim
(Continued)

FOREIGN PATENT DOCUMENTS

CN 201503905 6/2010
CN 102047502 5/2011
(Continued)

OTHER PUBLICATIONS

"Office Action of Taiwan Counterpart Application," issued on Dec. 24, 2015, p. 1-p. 8, in which the listed reference was cited.
A. Natarajan et al., "A fully Integrated 16-Element Phased-Array Eeceiver in SiGe BiCMOS for 60-GHz Communications," IEEE Journal of Solid-State Circuits, vol. 46, No. 5, May 2011, pp. 1-17.
(Continued)

*Primary Examiner* — Khai M Nguyen
(74) *Attorney, Agent, or Firm* — Jianq Chyun IP Office

(57) ABSTRACT

A connector including a first connector body and a mode-converting unit is provided. The first connector body includes a dielectric base, a shell and a pin set. The shell and the dielectric base are fixed to each other. The pin set is disposed on the dielectric base. The mode-converting unit includes a substrate and a mode-converting structure. The substrate is fixed to the first connector body and has a circuit. The shell constitutes a waveguide tube and is electromagnetically coupled to the circuit through the mode-converting structure. A signal is transmitted from the shell to the circuit through the mode-converting structure, or transmitted from the circuit to the shell through the mode-converting structure and emitted outward, such that the connector can be regarded as an antenna. The signal is a millimeter-wave signal.

39 Claims, 32 Drawing Sheets

(56) References Cited

U.S. PATENT DOCUMENTS

| | | | | |
|---|---|---|---|---|
| 7,710,338 | B2 * | 5/2010 | Fujishima | H01Q 1/243 343/700 MS |
| 7,724,204 | B2 | 5/2010 | Annamaa et al. | |
| 8,217,853 | B2 | 7/2012 | Tai et al. | |
| 8,233,950 | B2 * | 7/2012 | Hobson | H01Q 1/243 343/714 |
| 8,237,623 | B2 | 8/2012 | Hung | |
| 8,330,655 | B2 | 12/2012 | Zadesky et al. | |
| 8,798,554 | B2 * | 8/2014 | Darnell | H01Q 1/243 333/132 |
| 2002/0159716 | A1 | 10/2002 | Ohbayashi et al. | |
| 2009/0033574 | A1 | 2/2009 | Hung | |
| 2012/0218158 | A1 | 8/2012 | Park | |
| 2013/0052873 | A1 | 2/2013 | Riezebos et al. | |
| 2013/0109317 | A1 | 5/2013 | Kikuchi et al. | |

FOREIGN PATENT DOCUMENTS

| | | |
|---|---|---|
| TW | 200714004 | 4/2007 |
| TW | 201004037 | 1/2010 |
| TW | I350611 | 10/2011 |

OTHER PUBLICATIONS

Mohammad Fakharzadeh et al., "CMOS Phased Array Transceiver Technology for 60 GHz Wireless Applications," IEEE Transactions on Antennas and Propagation, vol. 58, No. 4, Apr. 2010, pp. 1-12.

Jing Gao et al., "Implementation Considerations of Patch Antenna Array for 60GHz Beam Steering System Applications," IEEE Radio and Wireless Symposium, Jan. 18-22, 2009, pp. 1-4.

Yoshihiko Konishi et al., "Millimeter-Wave Plastic Waveguide Phased Array Antenna," IEEE AP-S Symposium on AP/URSI, Jul. 11-17, 2010, pp. 1-4.

Maria Pardalopoulou and Klaus Solbach, "A Novel Waveguide Radiator Array Element for Metallized Plastics Antenna Technology," INICA 2003, InternationaleAntennentagung der VDE-ITG, Sep. 2003, pp. 1-3.

Chandrakanta Kumar et al., "Design of Short Axial Length High Gain Dielectric Rod Antenna," IEEE Transactions on Antennas and Propagation, vol. 58, No. 12, Dec. 2010, pp. 1-4.

A. A. Kishk et al., "Radiation Characteristics of the Short Dielectric Rod Antenna: A Numerical Solution," IEEE Transactions on Antennas and Propagation, vol. AP-35, No. 2, Feb. 1987, pp. 1-8.

* cited by examiner

CONNECTOR, ANTENNA AND ELECTRONIC DEVICE

CROSS-REFERENCE TO RELATED APPLICATION

This application claims the priority benefit of Taiwan application serial no. 102134838, filed on Sep. 26, 2013. The entirety of the above-mentioned patent application is hereby incorporated by reference herein and made a part of this specification.

TECHNICAL FIELD

The disclosure generally relates to a connector, an antenna and an electronic device.

BACKGROUND

An antenna is an essential component in wireless communication. As the demand for the amount of wirelessly transmitted data increases, the availability of a large bandwidth, such as a 7 GHz bandwidth for the 60 GHz band millimeter-wave communication, allows for a wide variety of applications in recent years. For instance, a millimeter-wave signal transceiver module may be disposed in a hand-held electronic device so that the hand-held electronic device may perform a high-speed wireless transmission through the millimeter-wave channel.

Currently, most of hand-held electronic devices adopts a unibody metal chassis, such that positions for installing a millimeter-wave antenna are further restricted. Moreover, the millimeter-wave signal may be resonantly and transversely transmitted inside of a metal cavity to reduce a radiation efficiency of the antenna. In case the small hand-held electronic device, such as a smart phone, includes multiple modules, components and antennas corresponding to various communication standards, when it comes to dispose a millimeter wave module into the already limited space, several problems may arise including spatial and functional interferences as well as the heat dissipation caused by the new installed millimeter wave module. It should also be noted that the millimeter wave antenna should not be blocked by user's hands when holding or operating the device. In short, for the millimeter wave module applied to consumer electronic products, many considerations including antenna gain, beam orientation and field of coverage, module's total volume, as well as manufacturing and assembling costs all need to be take into account. Other issues such as compatibility with existing components, operating gesture of a user are also to be considered. Moreover, a hand-held electronic device with a metal chassis may shield the millimeter-wave signal when the transceiver module inside it adopted an traditional planar patch array antenna. Therefore, it is required to provide an opening on the metal chassis above the antenna array for providing a path for electromagnetic wave propagation, which may smear the appearance of the hand-held electronic device. In addition, the beam direction of the patch array antenna disposed in the circuit board of the device is approximately perpendicular to the circuit board in the device. When the user operates the hand-held electronic device with normal holding position, the millimeter wave signal is transmitted towards the ground. Or, when two of the hand-held electronic devices are placed on a desktop for inter-device data transmission, the beam directions of the two devices are both towards the desktop instead of aiming each other. Therefore, the electromagnetic wave may not be effectively transceived, or unable to be transceived for the worst case. Moreover, when the user holds the hand-held electronic device, the patch array antenna disposed under a back lid of the hand-held electronic device is prone to be blocked by a hand portion of the user to reduce signal transceiving efficiency.

SUMMARY

In accordance with an embodiment of the disclosure, a connector includes a first connector body and a mode-converting unit. The first connector body includes at least one dielectric base, a shell and a pin set. The shell and the dielectric base are fixed to each other. The pin set is disposed on the dielectric base and configured to connect a second connector body. The mode-converting unit includes a substrate and at least one mode-converting structure. The substrate is fixed to the first connector body and has at least one circuit. The shell constitutes at least one waveguide tube of the mode-converting unit and is configured to transceive a signal. The circuit and the shell are electromagnetically coupled to each other through the mode-converting structure. A signal is transmitted from the shell to the circuit through the mode-converting structure, or transmitted from the circuit to the shell through the mode-converting structure and emitted outward, in which the signal is a millimeter-wave signal.

In accordance with an embodiment of the disclosure, an antenna includes a mode-converting unit and a first connector body. The mode-converting unit includes a substrate, at least one waveguide tube and at least one mode-converting structure. The substrate has at least one circuit. The waveguide tube is configured to wirelessly transceive a signal, in which the signal is a millimeter-wave signal. The circuit and the shell are electromagnetically coupled to each other through the mode-converting structure. The signal is transmitted from the waveguide tube to the circuit through the mode-converting structure, or transmitted from the circuit to the waveguide tube through the mode-converting structure and emitted outward. The first connector body includes at least one dielectric base and a pin set. The waveguide tube constitutes a shell of the first connector body and is fixed to the dielectric base. The pin set is disposed on the dielectric base and configured to connect a second connector body.

In accordance with an embodiment of the disclosure, an electronic device includes an outer shell, a circuit board, a first connector body and a mode-converting unit. An edge of the outer shell has an opening. The circuit board is disposed in the outer shell and has a signal transceiver module. The first connector body is disposed in the outer shell and aligned to the opening to become a connecting interface of the electronic device. The first connector body includes at least one dielectric base, a shell and a pin set. The shell and the dielectric base are fixed to each other. The pin set is disposed on the dielectric base. A second connector body is a connecting interface of an external device and adapted to be plugged to the first connector body through the opening. The pin set is configured to connect the second connector body. The mode-converting unit includes a substrate and at least one mode-converting structure. The substrate is fixed to the first connector body and has at least one circuit. The substrate is a part of the circuit board. The circuit is connected to the signal transceiver module. The shell constitutes at least one waveguide tube of the mode-converting unit and is configured to transceive a signal. The circuit and the shell are electromagnetically coupled to each other through the mode-converting structure. A signal is transmitted from the shell to the circuit through the mode-converting structure, or transmitted from the circuit to the shell through the mode-converting structure and emitted outward, in which the signal is a millimeter-wave signal.

To make the above features and advantages of the disclosure more comprehensible, several embodiments accompanied with drawings are described in detail as follows.

DETAILED DESCRIPTION

Figure 1:
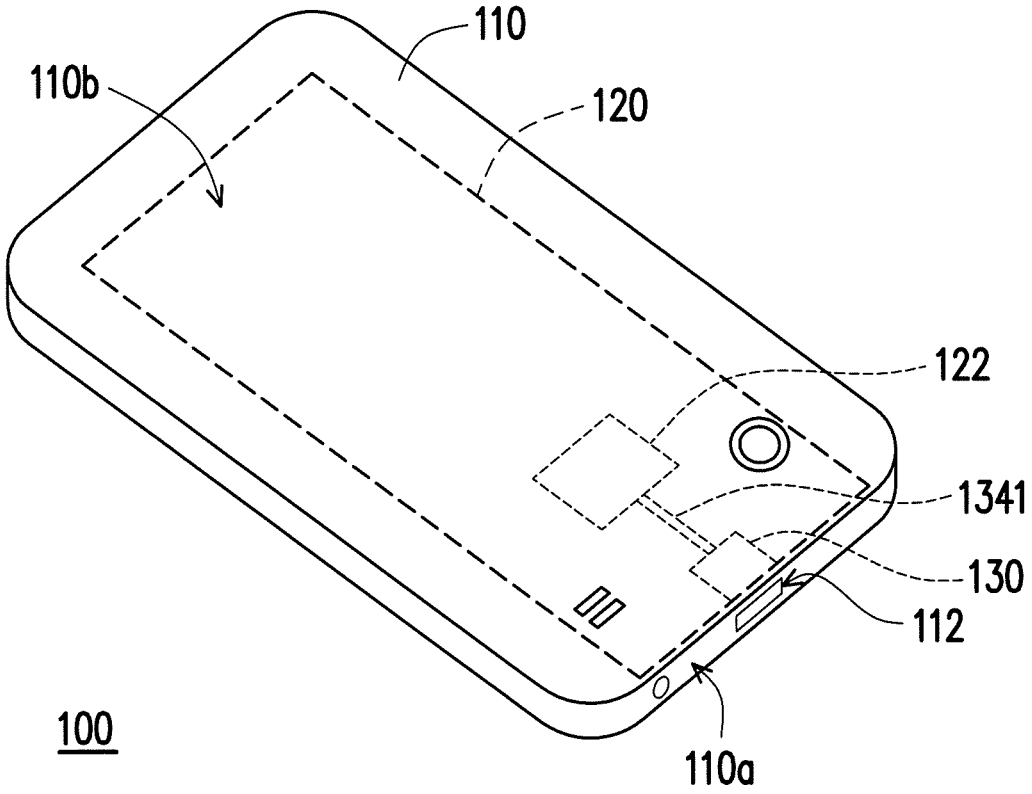
FIG. 1 is a 3D diagram of an electronic device in accordance with an embodiment of the disclosure.

FIG. 1 is a 3D diagram of an electronic device in accordance with an embodiment of the disclosure. Referring to FIG. 1, an electronic device 100 of the present embodiment includes an outer shell 110, a circuit board 120 and a connector 130. The circuit board 120 and the connector 130 are disposed in the outer shell 110 and illustrated in dash lines in FIG. 1, an edge 110*a* of the outer shell 110 has an opening 112 aligned to the connector 130. In the present embodiment, the electronic device 100 is, for example, a smartphone, a PDA, an audio/multimedia player and so on. In other embodiments, the electronic device 100 may also be devices of other types, and the disclosure is not limited thereto.

Figure 2:
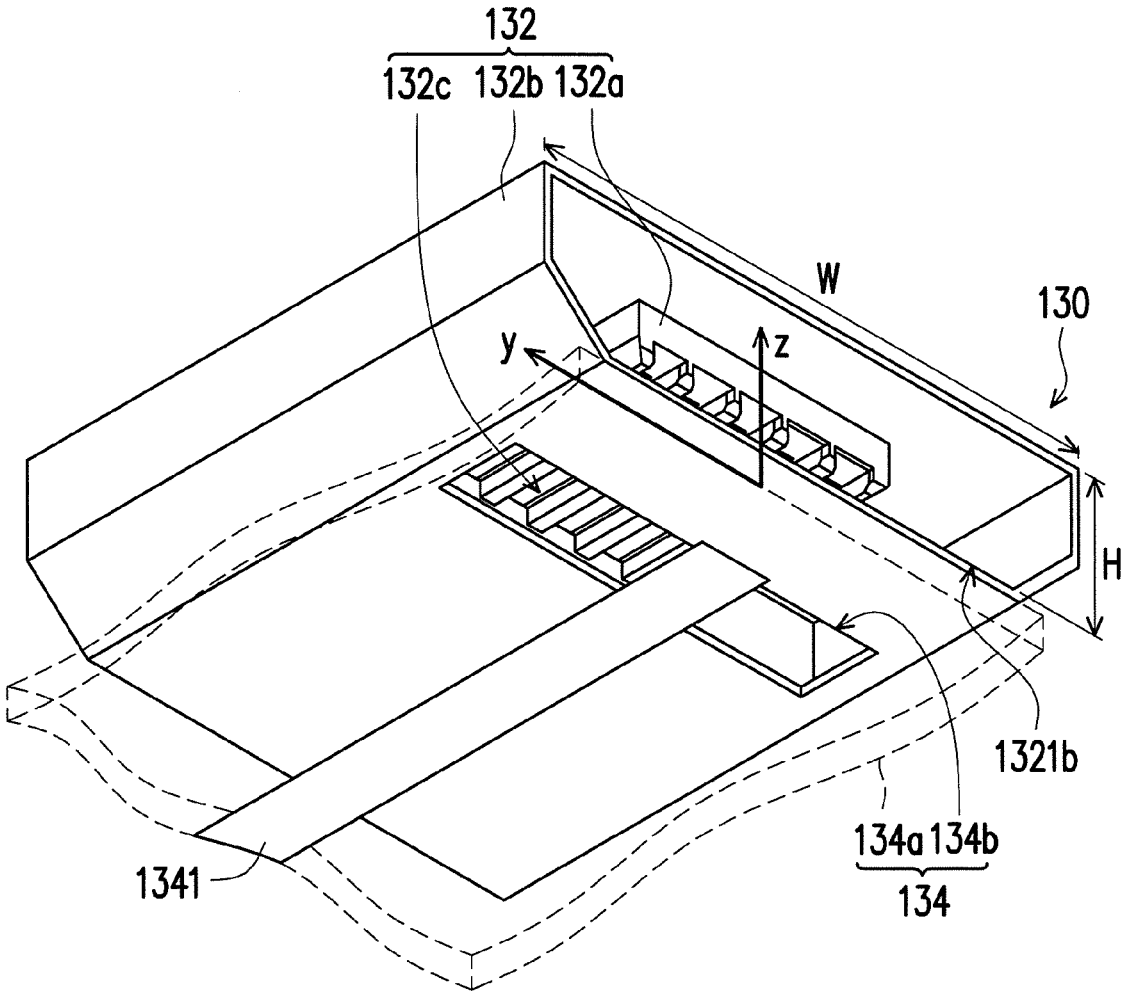
FIG. 2 is a 3D diagram of the connector of FIG. 1.
Figure 3:
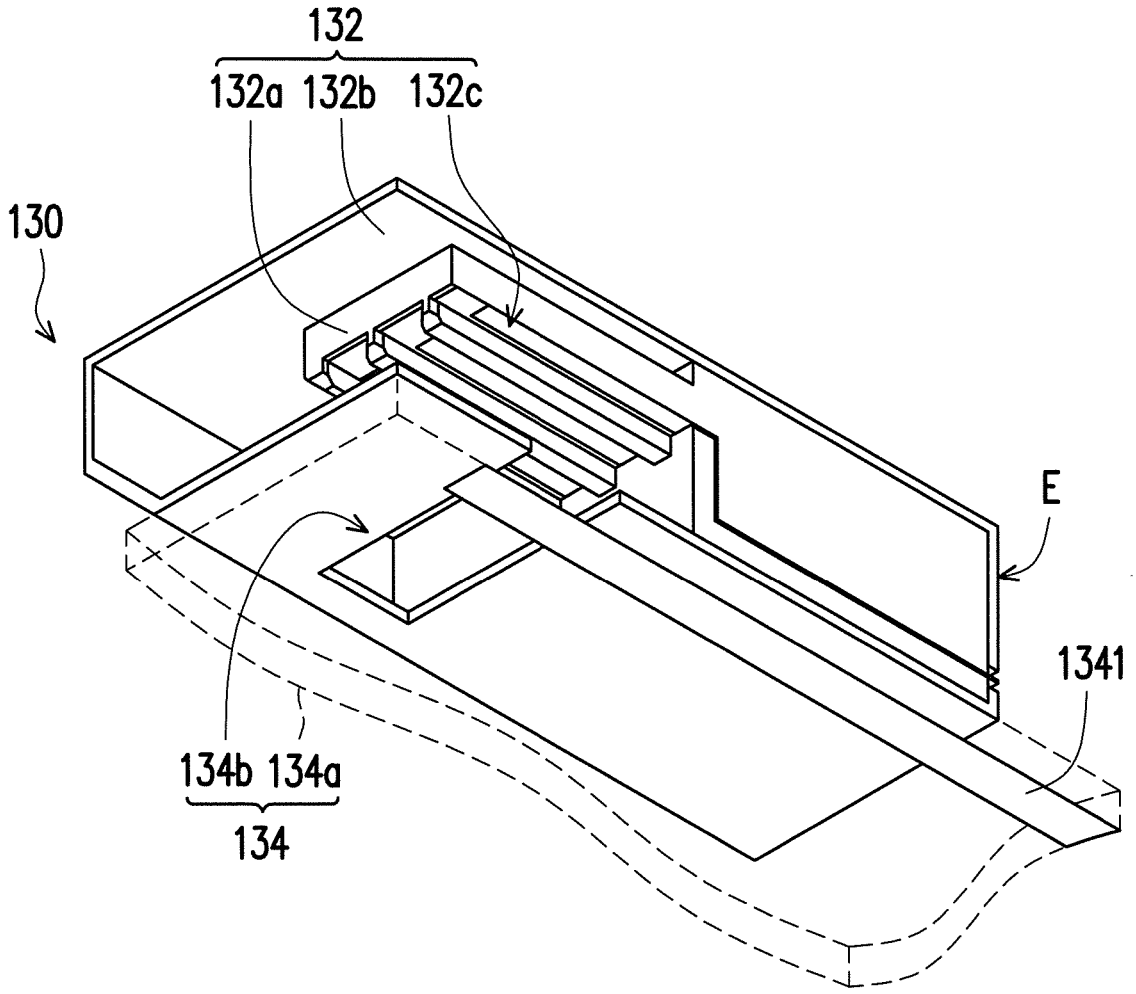
FIG. 3 is a 3D diagram of a partial structure of the connector of FIG. 2.
Figure 4:
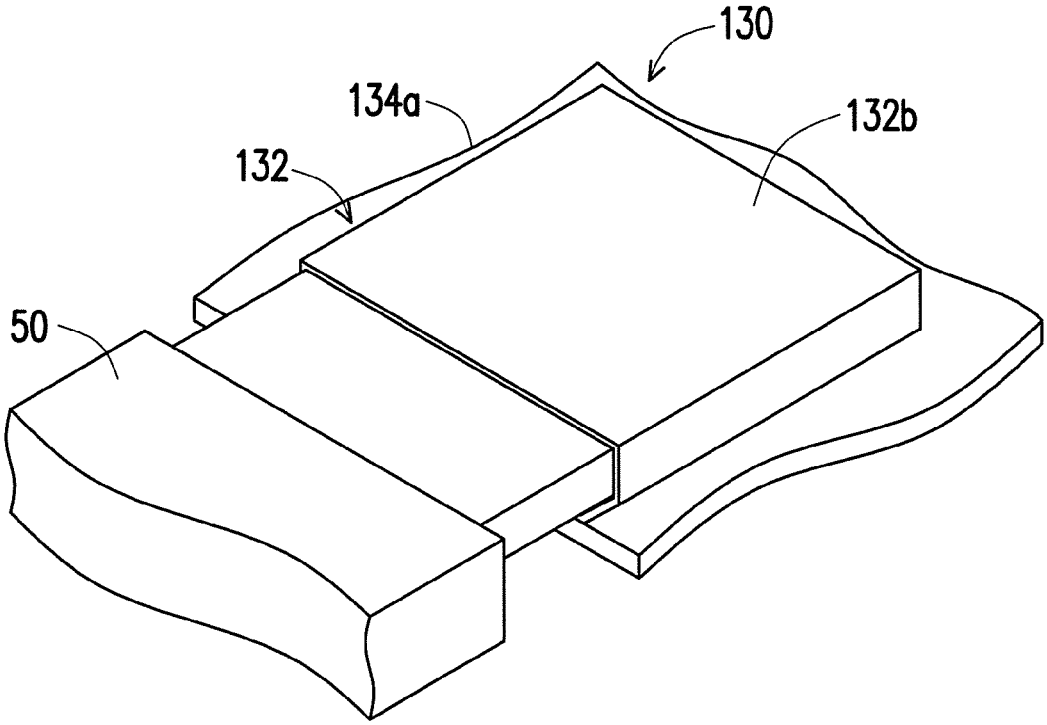
FIG. 4 illustrates a second connector body plugged to the first connector body of FIG. 2.

FIG. 2 is a 3D diagram of the connector of FIG. 1. FIG. 3 is a 3D diagram of a partial structure of the connector of FIG. 2. In order to simplify the drawing, a substrate 134*a* is illustrated in perspective view in both FIG. 2 and FIG. 3. Referring to FIG. 2 and FIG. 3, more specifically, the connector 130 includes a first connector body 132. The first connector body 132 is disposed in the outer shell 110 depicted in FIG. 1 and aligned to the opening 112 to become a connecting interface of the electronic device 100. The first connector body 132 includes at least one dielectric base 132*a* (only one is illustrated herein), a shell 132*b* and at least one pint set 132*c*. The shell 132*b* is a conductor made of, for example, a metal, but the disclosure is not limited thereto The shell 132*b* and the dielectric base 132*a* are fixed to each other, and the pin set 132*c* includes a plurality of pins and disposed on the dielectric base 132*a*. FIG. 4 illustrates a second connector body plugged to the first connector body of FIG. 2. Referring to FIG. 4, a second connector body 50 is, for example, a connecting interface of an external device and adapted to be plugged to the first connector body 132 through the opening 112 depicted in FIG. 1. The pin set 132*c* of the first connector body 132 is configured to connect a pin set (not illustrated) of the second connector body 50, so as that the electronic device 100 may perform data transmission or power transmission together with the external device. In the present embodiment, the first connector body 132 and the second connector body 50 are, for example, a universal serial bus (USB) connecting interface, an ear phone jack, a Lightning connecting interface manufactured by Apple, Inc. or connecting interfaces of other types, and the disclosure is not limited thereto.

Figure 5:
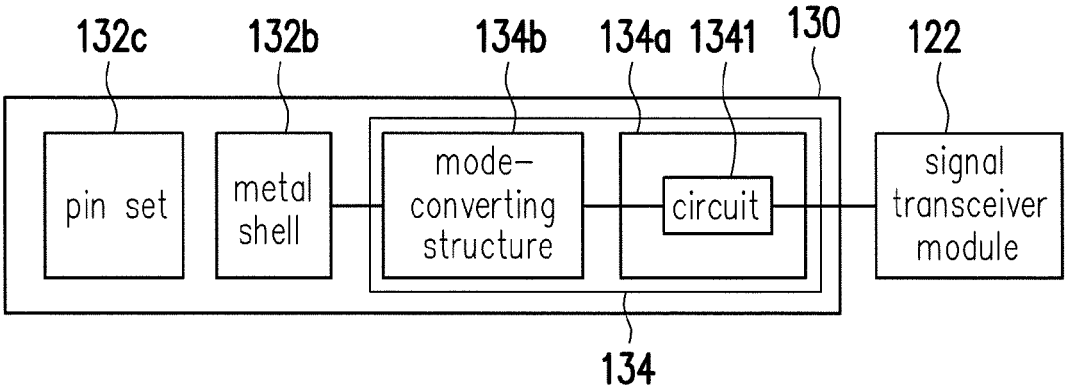
FIG. 5 is a block schematic diagram of the connector and the signal transceiver module of FIG. 1.
Figure 6A:
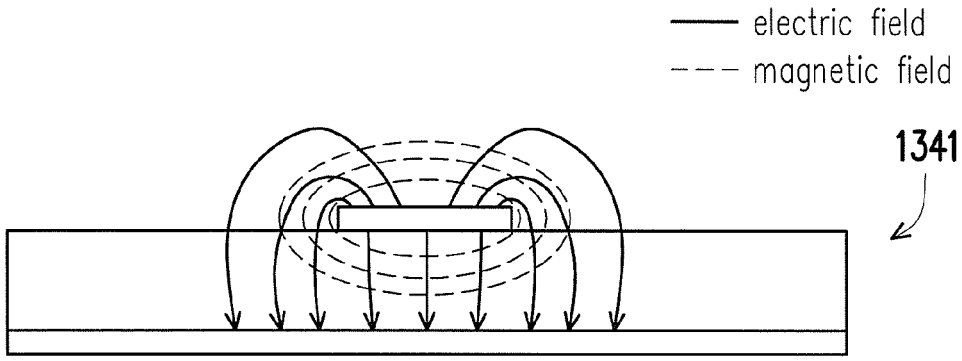
FIG. 6A and FIG. 6B illustrate propagation modes of electromagnetic field for the circuit and the shell of FIG. 5 respectively.
Figure 6B:
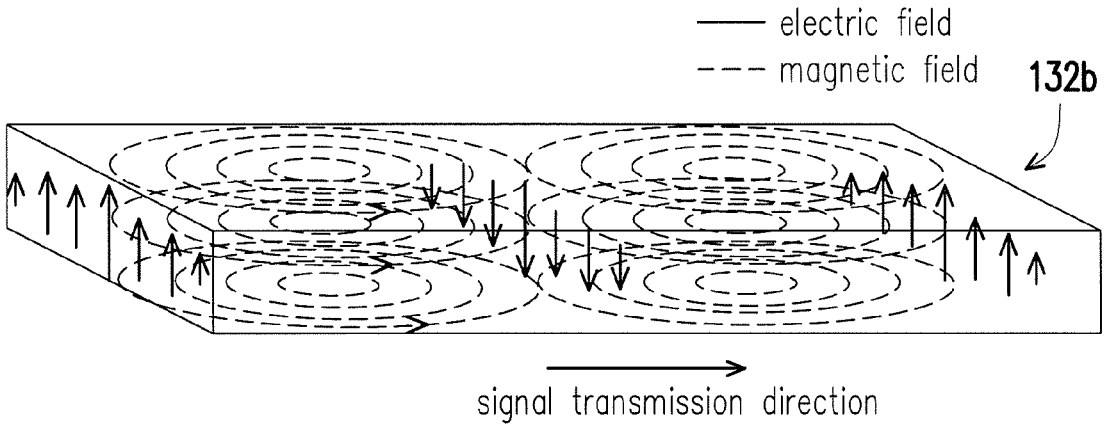

FIG. 5 is a block schematic diagram of the connector and the signal transceiver module of FIG. 1. Referring to FIG. 1 to FIG. 3 and FIG. 5, the connector 130 of the present embodiment further includes a mode-converting unit 134, and the circuit board 120 includes a signal transceiver module 122 configured to receive a signal from the mode-converting unit 134, or transmit a signal to the mode-converting unit 134. The signal transceiver module 122 is, for example, located on the circuit board 120. More specifically, the mode-converting unit 134 include a substrate 134*a* and at least one mode-converting structure 134*b* (in the present embodiment, it is one). The substrate 134*a* is a part of the circuit board 120 and fixed to the first connector body 132 and having at least one circuit 1341 (in the present embodiment, it is one). The circuit 1341 is connected to the signal transceiver module 122. The shell 132*b* of the first connector body 132 constitutes a waveguide tube of the mode-converting unit 134 and is configured to transceive the signal. The shell 132*b* has a slot to constitute the mode-converting structure 134*b*, the slot is, for example, a rectangular slot or other slot with appropriate shapes. The slot is aligned to an end of the circuit 1341, and a length of the slot is, for example, 0.1 to 0.75 times a wavelength of the signal. FIG. 6A and FIG. 6B illustrate propagation modes of electromagnetic field for the circuit and the shell of FIG. 5 respectively. By means of the mode-converting structure 134*b*, converting a propagation mode of electromagnetic field distribution of the circuit 1341 depicted in FIG. 6A into a propagation mode of the shell 132*b* (waveguide tube) depicted in FIG. 6B, or converting the propagation mode of the shell 132*b* (waveguide tube) depicted in FIG. 6B into the propagation mode of electromagnetic field distribution of the circuit 1341 depicted in FIG. 6A, an electromagnetic energy may be fed in from any end without causing excessively intense reflection. The signal is transmitted from the shell 132*b* to the circuit 1341 through the mode-converting structure 134*b*, or transmitted from the circuit 1341 to the shell 132*b* through the mode-converting structure 134*b* and emitted outward. In case the signal is transmitted from the shell 132*b* to the circuit 1341 through the mode-converting structure 134*b*, the mode-converting structure 134*b* may transform a mode of the signal, so that the signal from the shell 132*b* may continue to be transmitted through the circuit 1341. On the contrary, in case the signal is transmitted from the circuit 1341 to the shell 132*b* through the mode-converting structure 134*b*, the mode-converting structure 134*b* may transform a mode of the signal, so that the signal from the circuit 1341 may continue to be transmitted through the shell 132*b*.

The connector 130 of the present embodiment is capable of transceiving the signal as described above, so that connector 130 integrated with the mode-converting unit 134 is equivalent to an antenna integrated with connector functions. The waveguide tube of the mode-converting unit 134 of said antenna constitutes the shell 132*b* of the first connector body 132. In other words, the shell (which is equivalent to the waveguide tube) 132*b* is used by both the first connector body 132 and the mode-converting unit 134, such that the connector (which is equivalent to the antenna) 130 includes both functions of a traditional connector and functions for transceiving an electro-magnetic signal. Accordingly, the mode-converting unit 134 may successfully transceive the signal without disposing additional waveguide tubes, so that a disposing space may be saved to avoid signal interferences caused by other devices being too closed to the mode-converting unit 134. In addition, the connector 130 disposed through the opening 112 of the outer shell 110 of the electronic device 100 may connect to another external device, and the mode-converting unit 134 may also perform transmissions to the outside through the opening 112 without signal transceiving efficiency being reduced by blocking of the outer shell 110. In addition, since the connector 130 is disposed adjacent to the edge 110*a* of the outer shell 110 of the electronic device 100 instead of being disposed adjacent to a back surface 110*b* of the outer shell 110, the mode-converting unit 134 being integrated in the connector 130 may transceive the signal in a more preferable direction so as to further improve the signal transceiving efficiency. Furthermore, since the mode-converting unit 134 is disposed on the edge 110*a* of the outer shell 110 of the electronic device 100 as described above, when a user holds the electronic device 100, the mode-converting unit 134 may still maintain in a favorable signal transceiving capability without being blocked by a hand portion of the user.

In the present embodiment, a section of an opening 1321*b* of the shell (which is equivalent to the waveguide tube) 132*b* is related to a cut-off frequency of the shell 132*b*, so that the shell 132*b* may transceive a millimeter-wave signal. More specifically, a size and a signal wavelength of the waveguide tube are in a proportional relation, and a wavelength of the millimeter-wave signal is relatively shorter than a wavelength of a microwave signal. Therefore, the size of the shell of the connector is generally between several millimeters and several centimeters, and the shell of the connector could serve as the waveguide tube of millimeter-wave signal. Generally, the cross-section of a rectangular waveguide tube is defined by a width multiplied by a height. For instance, referring to FIG. 2, in the opening 1321*b* of the shell 132*b*, relations between a height H, a width W and said cut-off frequency $f_{cut\ off}$, velocity of wave c and transmission mode parameters m and n (m and n are integers), may be expressed by the following formula:

The cut-off frequency $$f_{cutoff} = \frac{c}{2\pi}\sqrt{\left(\frac{n\pi}{W}\right)^2 + \left(\frac{m\pi}{H}\right)^2},$$

$$\lambda_{cut\ off} = \frac{c}{f_{cutoff}}$$

If the wave guide tube is filled with dielectric material having dielectric constant $\in_r$, then the velocity of wave would decrease with a rate of $1/\in_r^{0.5}$ and the cut-off frequency would also decrease with the same rate, such that the wave guide tube with identical cross-section is capable of transmitting signals of lower frequencies.

Accordingly, the opening 1321*b* of the shell 132*b* may transceive the millimeter-wave signal. In addition, as shown in FIG. 3, the shell 132*b* of the connector 130 may be designed to include, for example, a closed end E, so that the signal may be transmitted along the shell 132*b* in one single direction, thereby preventing an outside signal or a signal excited by the mode-converting unit 134 from directly entering the electronic device 100 through the shell 132*b*.

Figure 7:
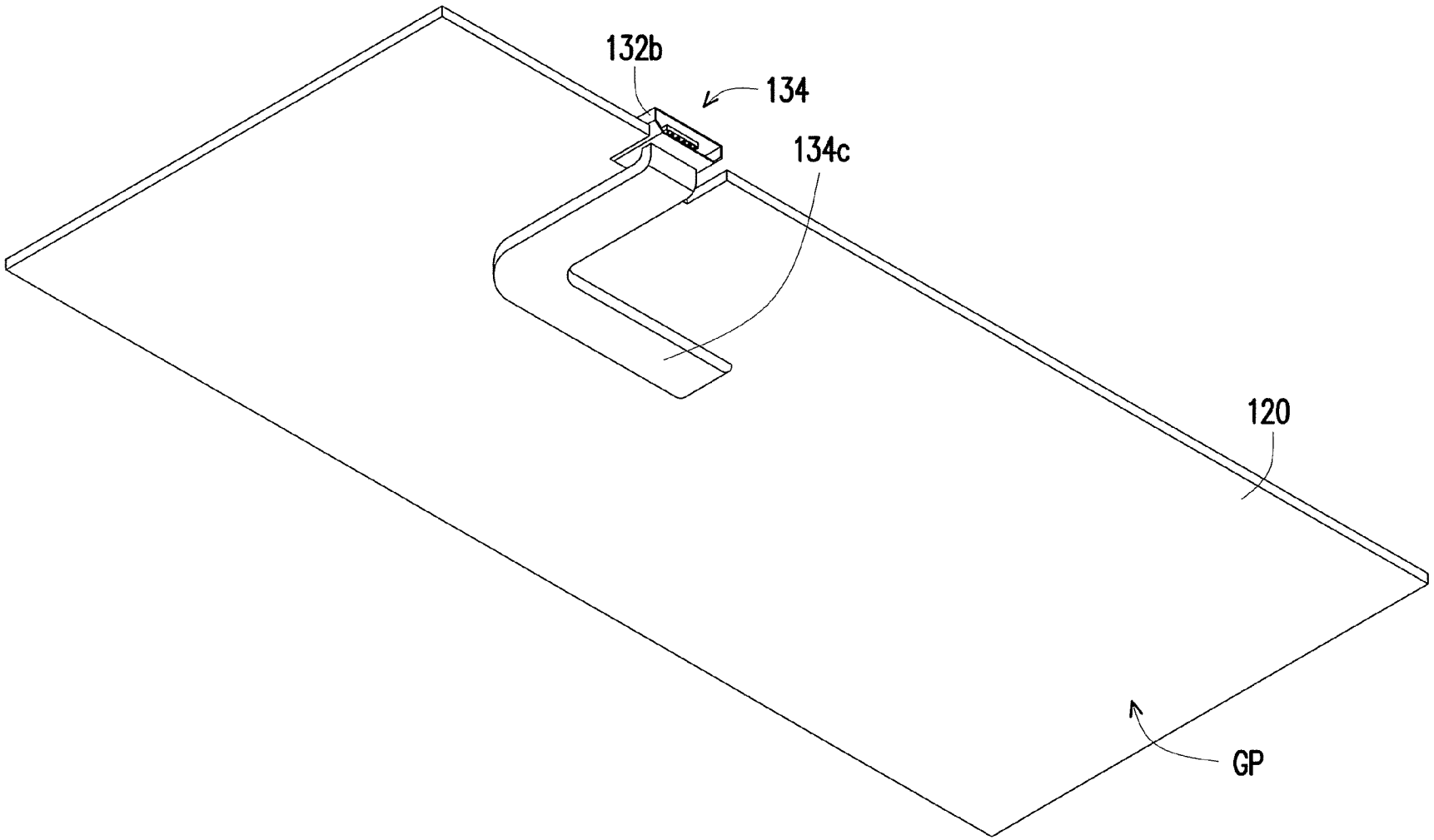
FIG. 7 is a 3D diagram of a connector and a circuit board in accordance with another embodiment of the disclosure.
Figure 8:
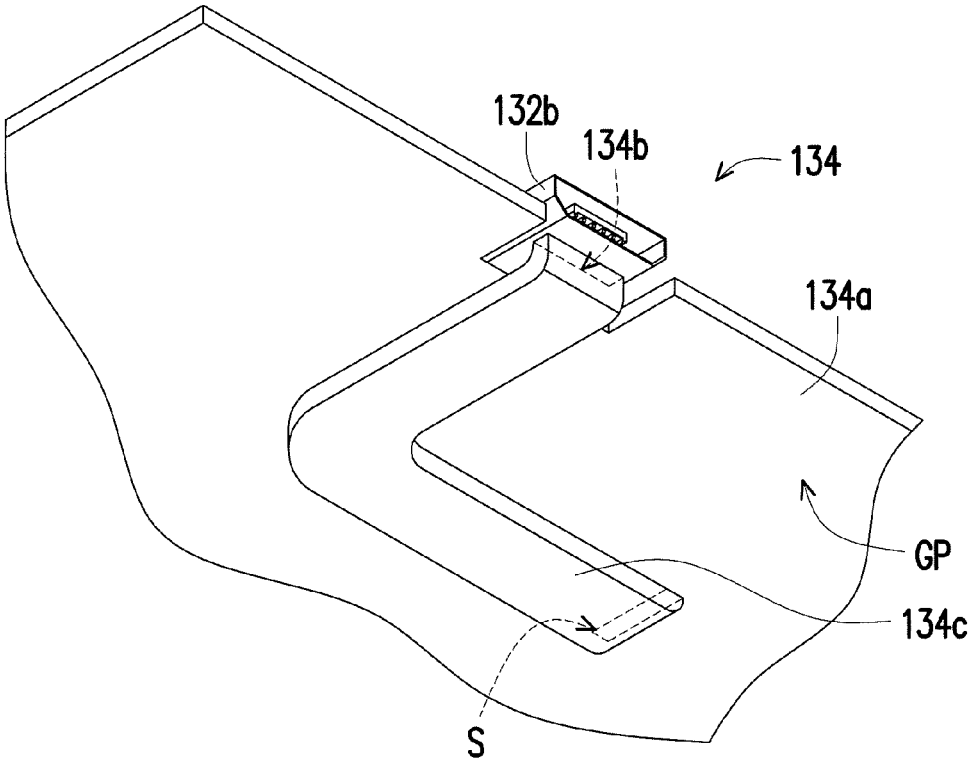
FIG. 8 is a partially enlarged diagram of the connector and the circuit board of FIG. 7.
Figure 9:
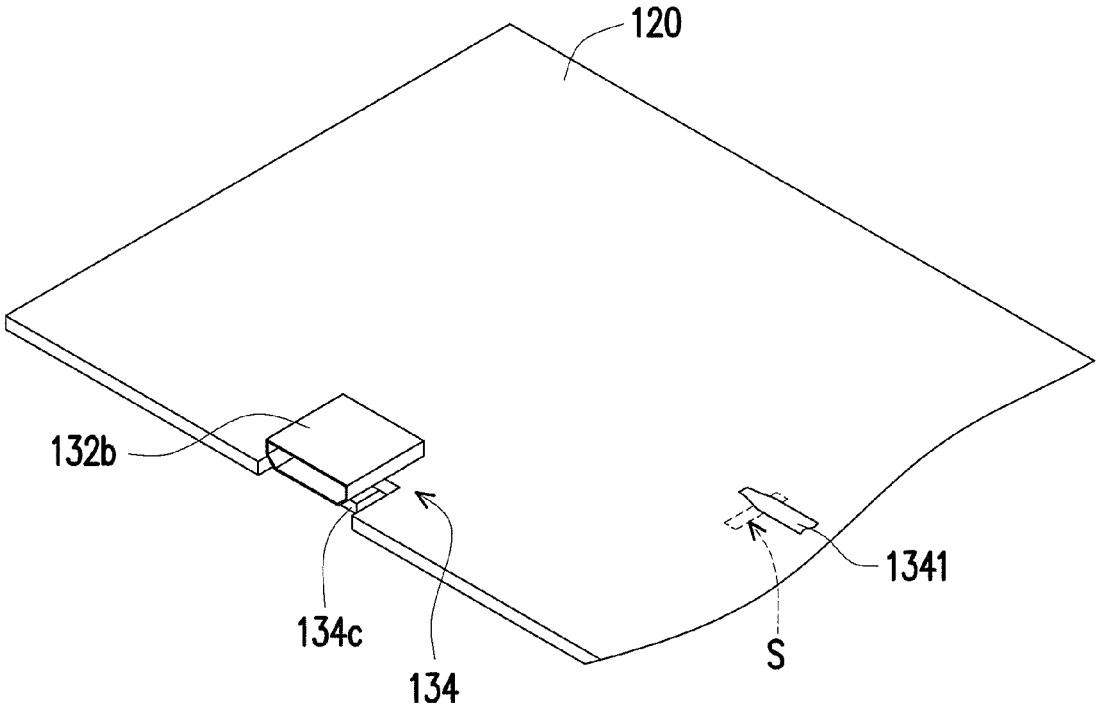
FIG. 9 is a 3D diagram of the connector and the circuit board of FIG. 7 from another perspective.

In the embodiments of FIG. 2 and FIG. 3, if the signal transceiver module is relatively farther from the shell of the connector, a waveguide tube structure may be disposed between the connector and the circuit to improve the signal transmission efficiency thereof, and related details are described below. FIG. 7 is a 3D diagram of a connector and a circuit board in accordance with another embodiment of the disclosure. FIG. 8 is a partially enlarged diagram of the connector of FIG. 7. FIG. 9 is a 3D diagram of the connector and the circuit board of FIG. 7 from another perspective. Differences between the embodiments depicted in FIG. 7 to FIG. 9 and the embodiments depicted in FIG. 2 and FIG. 3 are that, in FIG. 7 to FIG. 9, the mode-converting unit 134 further includes a waveguide tube structure 134*c*; a grounding plane GP of a substrate 134*a* (marked in FIG. 8, which is a portion of the circuit 120 depicted in FIG. 7) has another slot S; the waveguide tube structure 134*c* is connected between the slot (the mode-converting unit 134*b*) of the shell 132*b* and the another slot S of the grounding plane GP; and the circuit 1341 is aligned to the another slot S so that the millimeter-wave signal may transmitted through the waveguide tube structure 134*c*. Therein, a length of the slot S is, for example, 0.1 to 0.75 times a wavelength of the signal. In the present embodiment, degrees of freedom in space disposition of the circuit board 120 may increased, and a physical length for the millimeter-wave signal to transmit through a non-closed or a coaxial millimeter waveguide (e.g., the circuit 1341) may also be reduced by disposing the waveguide tube structure 134*c*, so as to reduce losses in the transmission of the millimeter-wave signal or unexpected radiation dissemination.

Figure 10:
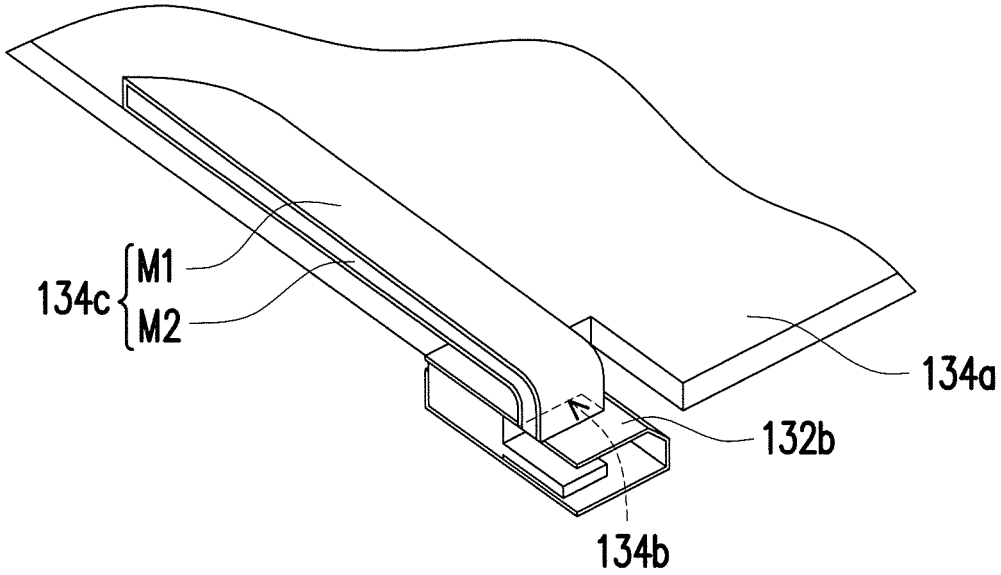
FIG. 10 is a 3D diagram of a partial structure of the connector and the circuit board of FIG. 8.
Figure 11:
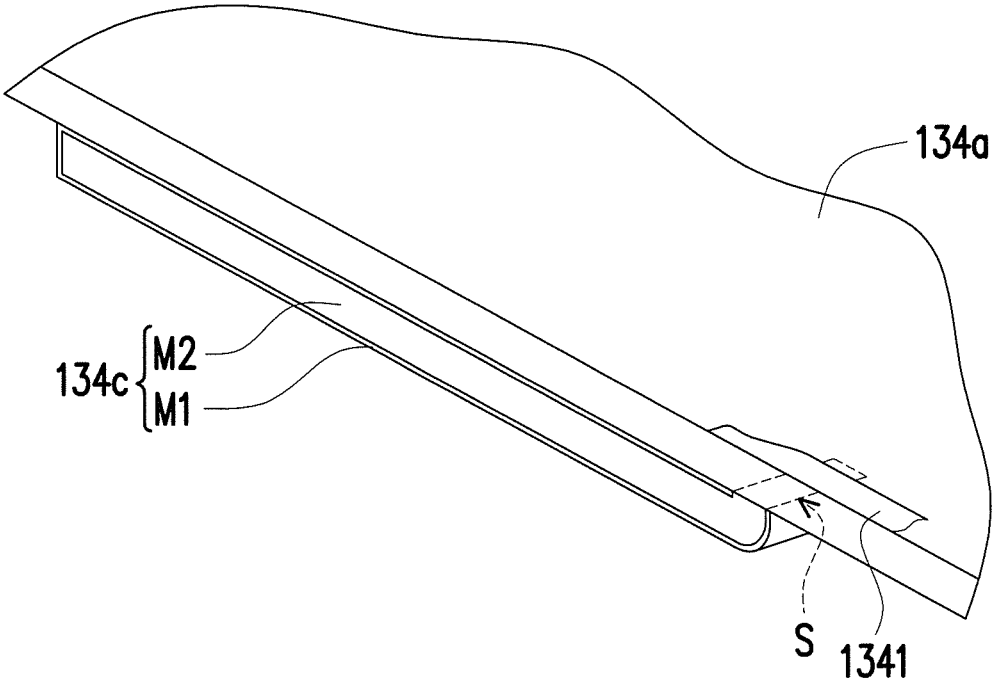
FIG. 11 is a 3D diagram of a partial structure of the connector and the circuit board of FIG. 8.

FIG. 10 is a 3D diagram of a partial structure of the connector and the circuit board of FIG. 8. FIG. 11 is a 3D diagram of a partial structure of the connector and the circuit board of FIG. 8. Referring to FIG. 10 and FIG. 11, the waveguide tube structure 134*c* of the present embodiment includes an outer-shell M1 and a dielectric material M2. The outer-shell M1 is a conductor made of, for example, a metal, but the disclosure is not limited thereto. The dielectric material M2 may be, for example, a plastic material, such as polyethylene, polycarbonate, polytetrafluoroethylene, or other appropriate dielectric materials, and the disclosure is not limited thereto. In addition, the waveguide tube structure 134*c* may become a hollow structure by not filling the dielectric material M2 into the outer-shell M1, which is not particularly limited in the disclosure.

Figure 12:
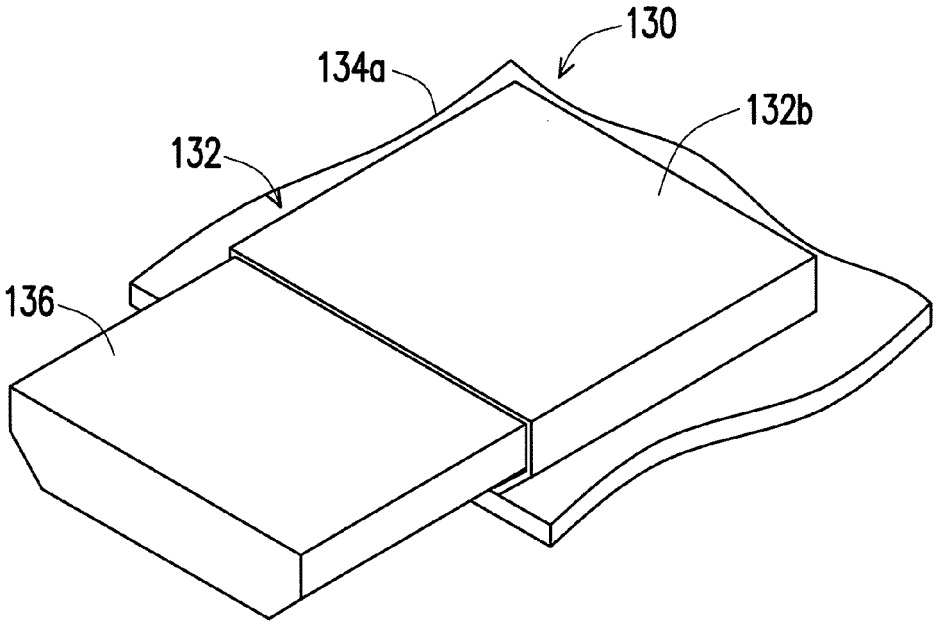
FIG. 12 illustrates a dielectric waveguide structure plugged to the first connector body of FIG. 2.
Figure 13:
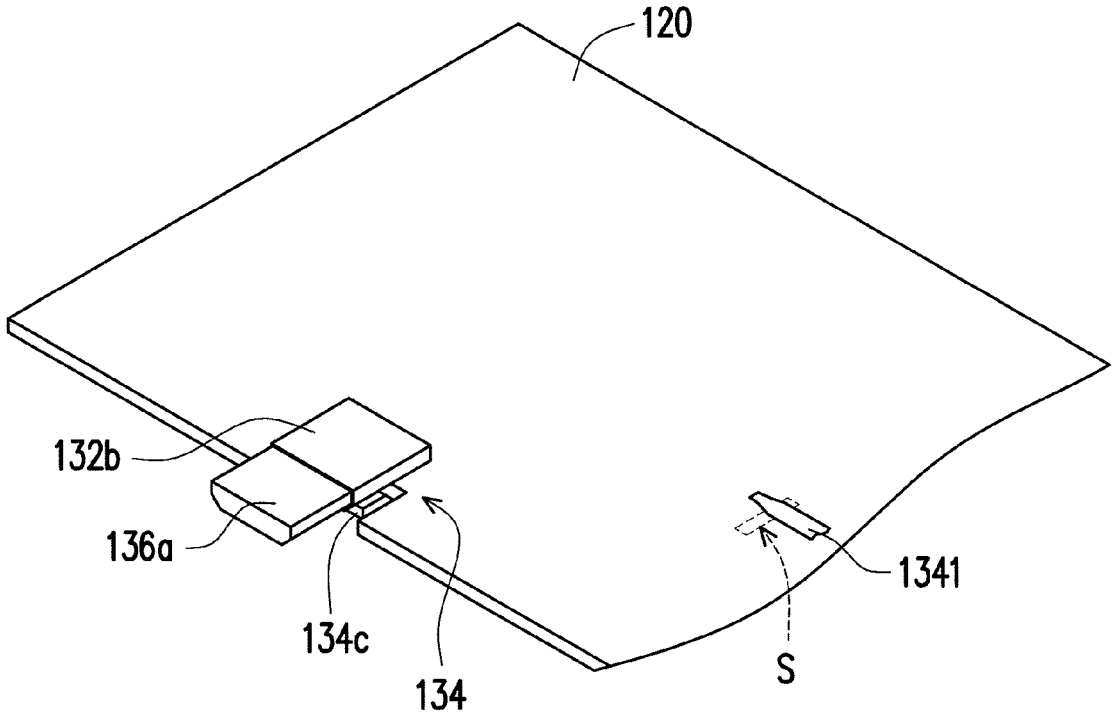
FIG. 13 illustrates a dielectric waveguide structure plugged to the shell of FIG. 9.

Other than being plugged by the connecting interface (e.g., the second connector body 50) of the external device for transmitting data or power as depicted in FIG. 4, the connector 130 of the present embodiment may also be plugged by the dielectric waveguide structure to further increase the signal transceiving capability of the mode-converting unit 130, and related detail are as described below. FIG. 12 illustrates a dielectric waveguide structure plugged to the first connector body of FIG. 2. Referring to FIG. 12, the connector 130 of the present embodiment further includes a dielectric waveguide structure 136. The dielectric waveguide structure 136 is a radiator and configured to be plugged to the first connector body 132 through the opening depicted in FIG. 1, and the shell 132*b* transceives the signal through the dielectric waveguide structure 136. The dielectric waveguide structure is, for example, a dielectric rod antenna or the dielectric waveguide tube, made of, for example, a plastic material, or other appropriate dielectric materials, and the disclosure is not limited thereto. FIG. 13 illustrates a dielectric waveguide structure plugged to the shell of FIG. 9. Similarly, as shown in FIG. 13, the dielectric waveguide structure 136*a* may be plugged to the shell 132*b* depicted in the embodiment of FIG. 9, and the shell 132*b* may transceive the signal through the dielectric waveguide structure 136*a*. A shape of the dielectric waveguide structure 136 depicted in FIG. 12 and FIG. 13 is merely an example, but the shape of the dielectric waveguide structure is not particularly limited by the disclosure. Details regarding the same are described below with reference to the drawing.

Figure 14A:
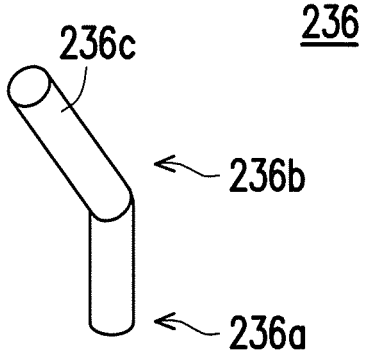
FIG. 14A to FIG. 14C are 3D diagrams of dielectric waveguide structures in accordance with other embodiments of the disclosure.
Figure 14B:
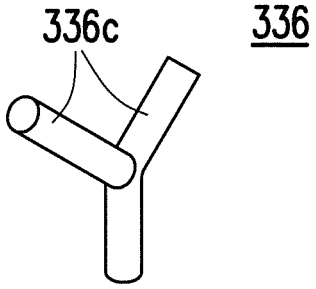
Figure 14C:
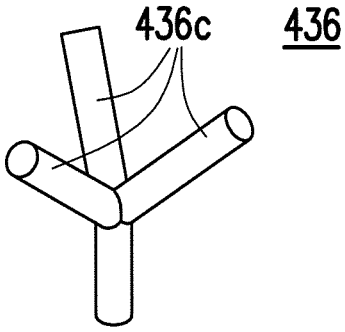

FIG. 14A to FIG. 14C are 3D diagrams of dielectric waveguide structures in accordance with other embodiments of the disclosure. In FIG. 14A, an end 236*a* of the dielectric waveguide structure 236 is, for example, configure to be plugged to the first connector body 132, and another end 236*b* of the dielectric waveguide structure 236 has a bent portion 236*c*. The dielectric waveguide structure 236 may transceive the signal in appropriate direction of beam through a bent angle of the bent portion 236*c*. A number of the bent portion of the dielectric waveguide structure is not particularly limited in the disclosure. For instance, a dielectric waveguide structure 336 depicted in FIG. 14 includes two bent portions 336*c*, whereas a dielectric waveguide structure 436 includes three bent portions 436*c*, such that the dielectric waveguide structure may transceive the signal along a plurality of directions of beam through multiple bent portions.

Figure 15A:
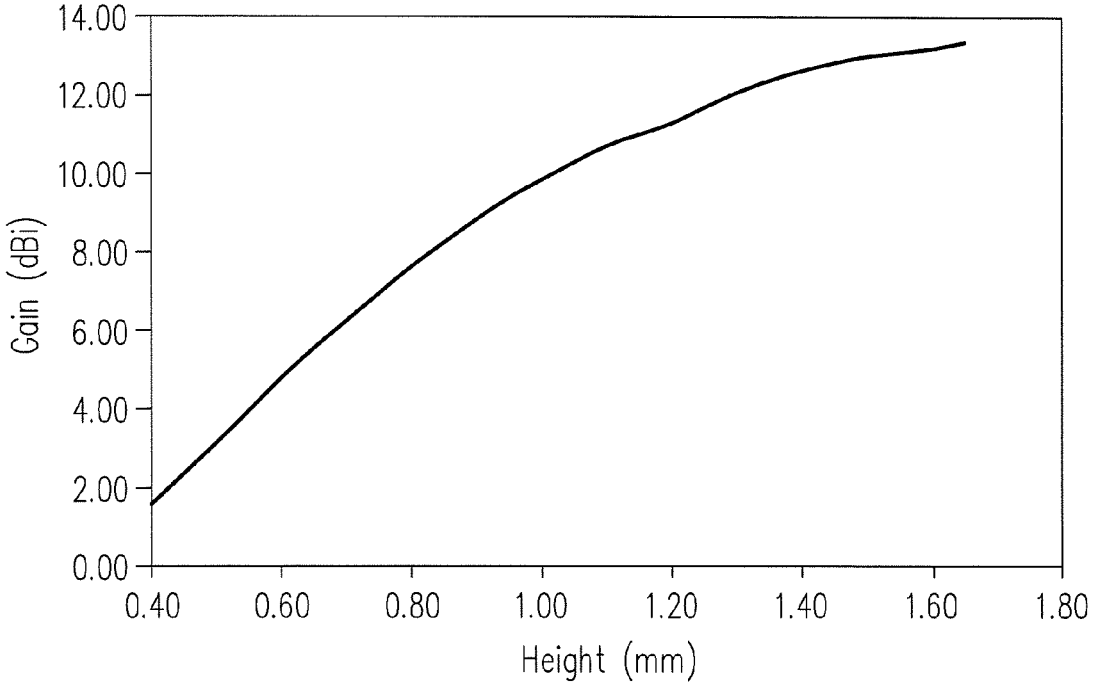
FIG. 15A illustrates a relation between a size and a gain of a dielectric waveguide antenna.
Figure 15B:
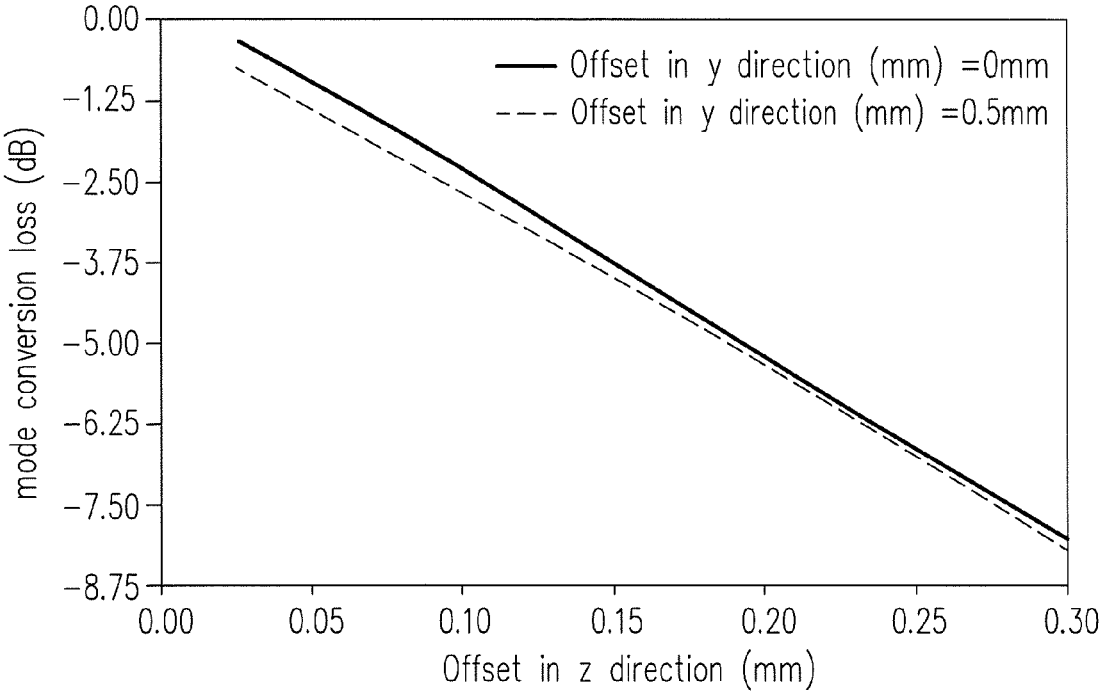
FIG. 15B illustrates a relation in which a relative displacement of the circuit and the mode-converting unit is related to a mode conversion loss thereof.

In the foregoing embodiments, the shell (which is equivalent to the waveguide tube) is deemed as an antenna structure; an electromagnetic wave is radiated through the opening of the shell or the dielectric waveguide structure; a gain of the antenna is positively proportional to an area of the opening of the waveguide tube or a sectional area of the dielectric waveguide structure; a size of a dielectric waveguide antenna and a gain thereof is as shown in FIG. 15A. Therein, a width of the dielectric waveguide is, for example, fixed to 6.7 mm; when the sectional area of the dielectric waveguide structure is 1.64 mm×6.7 mm (a size of the shell of a USB connector), the gain may reach 13 dBi; when a height of the dielectric waveguide antenna is reduced to 0.5 mm, the gain is reduced to approximately 3 dBi. Therefore, in case the connector is served as the antenna, a highest gain may be obtained by using a height of the shell of USB connector to be a height of the waveguide. As shown in FIG. 15B, a relative displacement of the circuit and the mode-converting unit may cause a mode conversion loss additionally, when an offset at y direction (marked in FIG. 2) is 0 to 0.5 mm, the mode conversion loss caused by an offset at z direction (marked in FIG. 2) may reach 8.75 dB. Since the foregoing embodiment all adopt a fixed design instead of a detachable design, the shell 132*b* depicted in FIG. 2 is fixed on the substrate 134*a*, so as to avoid the relative displacement of the circuit and the mode-converting unit caused by service wear or deformation of a detachable structure after being used for a long period of time, thereby causing the mode conversion loss additionally.

Figure 16:
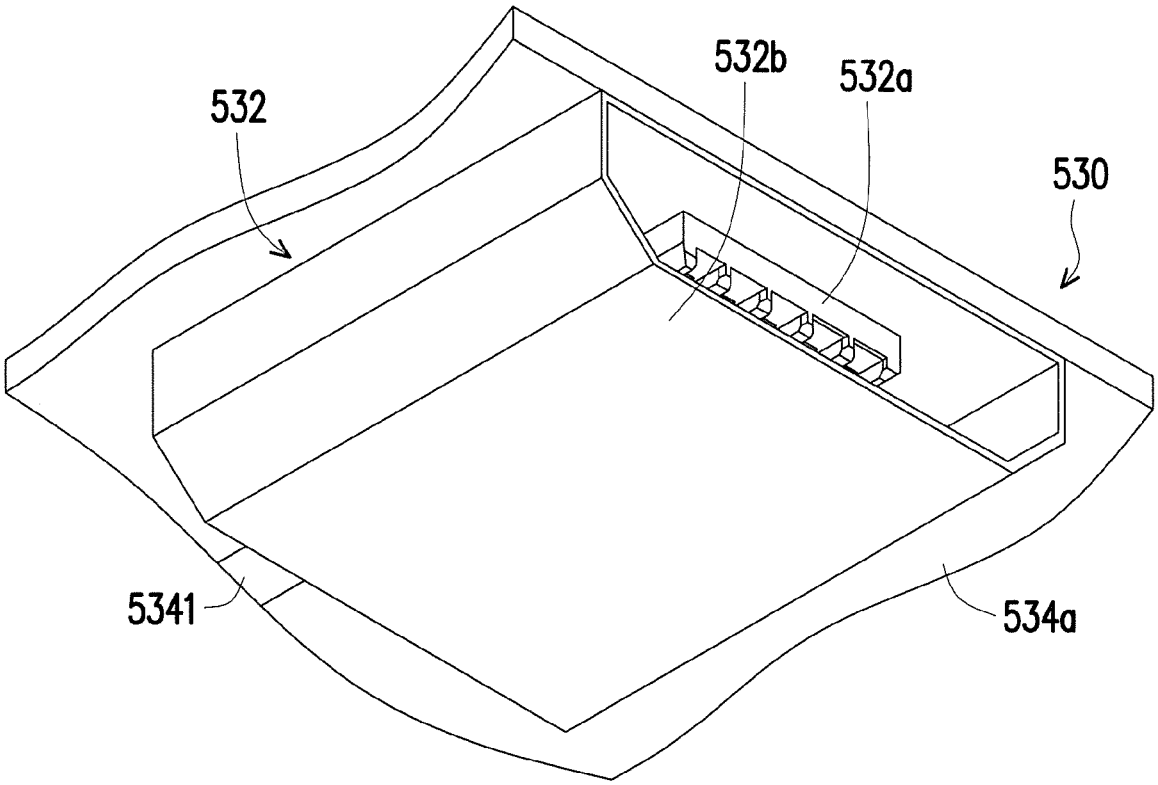
FIG. 16 is a 3D diagram of a connector in accordance with another embodiment of the disclosure.
Figure 17:
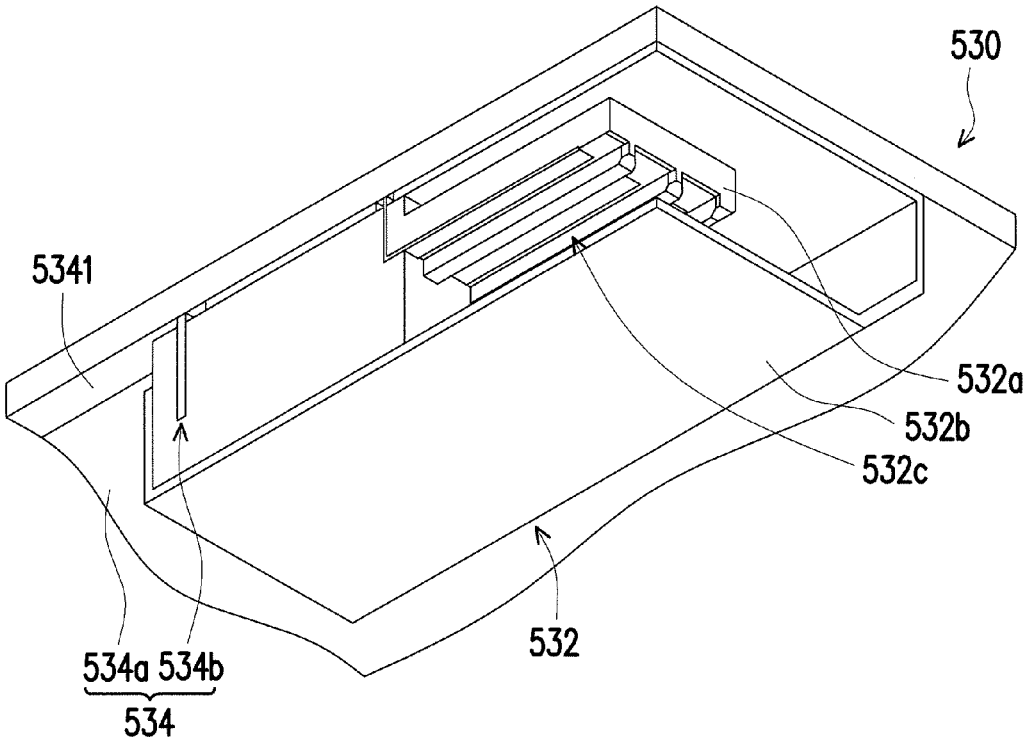
FIG. 17 is a 3D diagram of a partial structure of the connector of FIG. 16.

In the embodiments of FIG. 2 and FIG. 3, the mode-converting structure 134*b* is in form of a slot, but the disclosure is not limited thereto. Details regarding the same are described below with reference to the drawing. FIG. 16 is a 3D diagram of a connector in accordance with another embodiment of the disclosure. FIG. 17 is a 3D diagram of a partial structure of the connector of FIG. 16. Referring to FIG. 16 and FIG. 17, in a connector 530 of the present embodiment, dispositions and actions of a first connector body 532, a dielectric base 532*a*, a shell 532*b*, a pin set 532*c*, a mode-converting unit 534, a substrate 534*a* and a circuit 5341 are similar to dispositions and actions of the first connector body 132, the dielectric base 132*a*, the shell 132*b*, the pin set 132*c*, the mode-converting unit 134, the substrate 134*a* and the circuit 1341 depicted in FIG. 2 and FIG. 3, and the mode-converting unit may also be integrated in the connector as the foregoing embodiments, thus related descriptions thereof are omitted hereinafter. A difference between the connector 530 and the connector 130 is that, a mode-converting structure 534*b* is in form of a probe instead of the slot. More specifically, an end of the circuit 5341 has a probe structure to constitute the mode-converting structure 534*b*; the probe structure is adjacent to the shell 532*b*; a length of the probe structure is, for example, less than a height of the shell 532*b* so as to avoid generating short circuit together with the shell 532*b*; and the circuit 5341 and the shell 532*b* are coupled to each other through the mode-converting structure 534*b*. In case the signal is transmitted from the shell 532*b* to the circuit 5341 through the mode-converting structure 534*b*, the mode-converting structure 534*b* may convert a mode of the signal, so that the signal from the shell 532*b* may continue to be transmitted through the circuit 5341. On the contrary, in case the signal is transmitted from the circuit 5341 to the shell 532*b* through the mode-converting structure 534*b*, the mode-converting structure 534*b* may convert a mode of the signal, so that the signal from the circuit 5341 may continue to be transmitted through the shell 532*b*.

Figure 18:
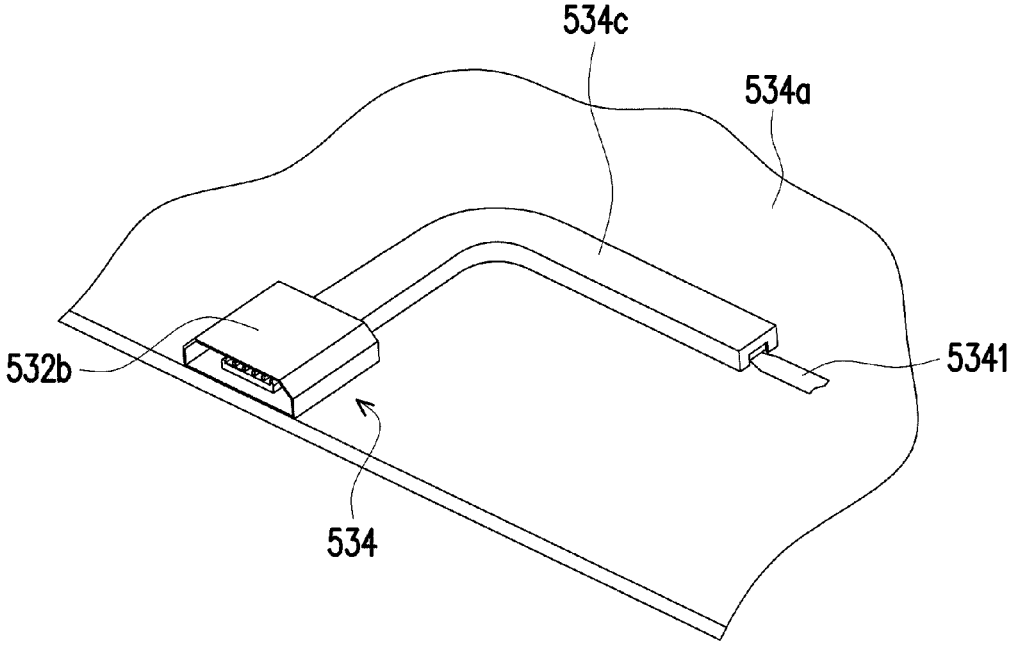
FIG. 18 is a 3D diagram of a connector and a circuit board in accordance with another embodiment of the disclosure.
Figure 19:
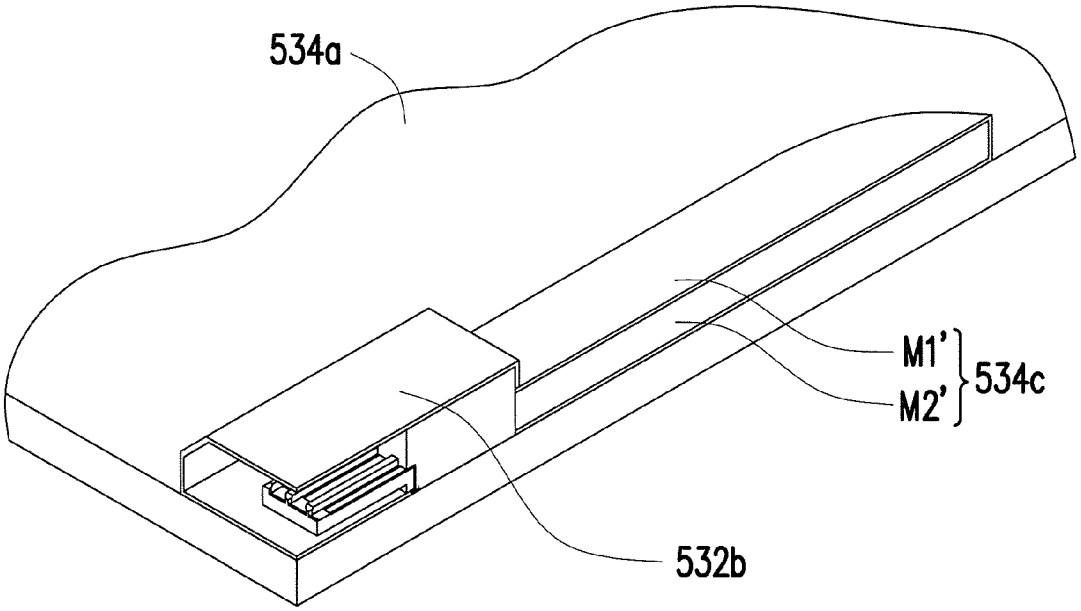
FIG. 19 is a 3D diagram of a partial structure of the connector and the circuit board of FIG. 18.
Figure 20:
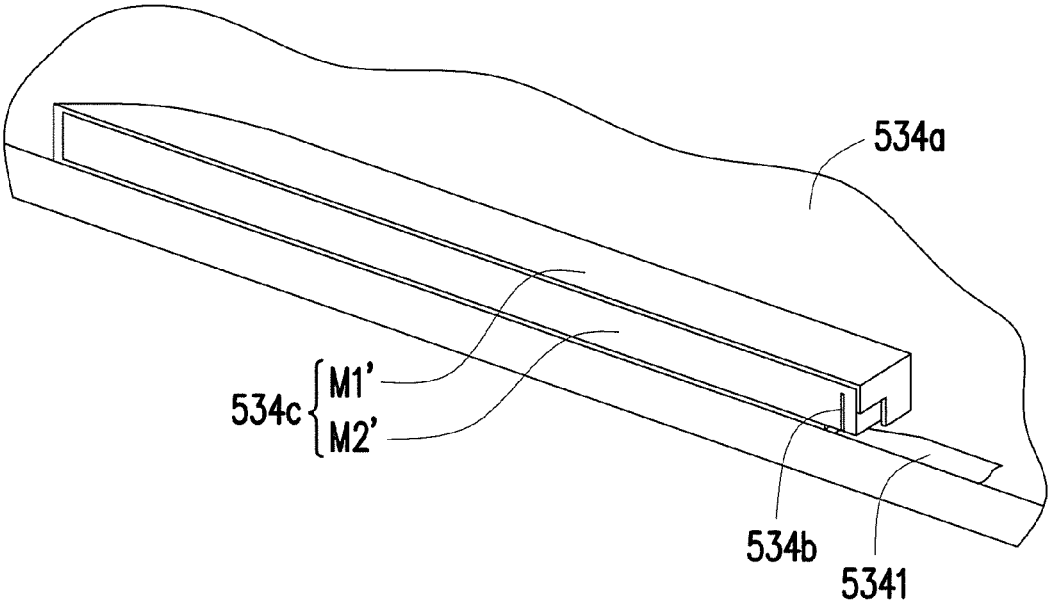
FIG. 20 is a 3D diagram of a partial structure of the connector and the circuit board of FIG. 18.

In the embodiments of FIG. 16 and FIG. 17, if the signal transceiver module is relatively farther from the shell of the connector, a waveguide tube structure may be disposed between the connector and the circuit to improve the signal transmission efficiency thereof, and related details are described below. FIG. 18 is a 3D diagram of a connector and a circuit board in accordance with another embodiment of the disclosure. FIG. 19 is a 3D diagram of a partial structure of the connector and the circuit board of FIG. 18. FIG. 20 is a 3D diagram of a partial structure of the connector and the circuit board of FIG. 18. Differences between the embodiments depicted in FIG. 18 to FIG. 20 and the embodiments depicted in FIG. 16 and FIG. 17 are that, in FIG. 18 to FIG. 20, the mode-converting unit 534 further includes a waveguide tube structure 534*c*; the waveguide tube structure 534*c* is connected between the shell 532*b* and the probe structure (the mode-converting structure 534*b*) at the end of the circuit 5431, so that the millimeter-wave signal may be transmitted through the waveguide tube structure 534*c*. By doing so, degrees of freedom in space disposition of the circuit board may be increased, and a physical length for the millimeter-wave signal to transmit through a planar or a coaxial millimeter waveguide (e.g., the circuit 5341) may also be reduced by disposing the waveguide tube structure 534*c*, so as to reduce losses in the transmission of the millimeter-wave signal.

Figure 21:
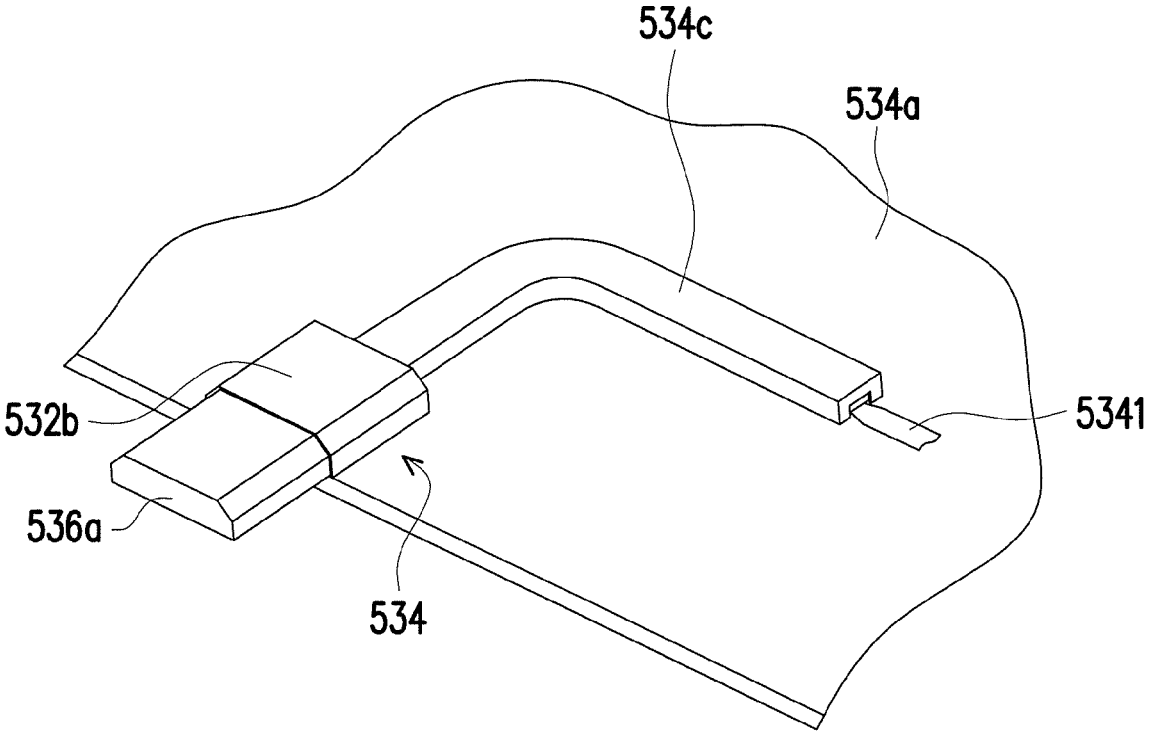
FIG. 21 illustrates a dielectric waveguide structure plugged to the shell of FIG. 18.

Referring to FIG. 19 and FIG. 20, the waveguide tube structure 534*c* includes an outer-shell M1' and a dielectric material M2'. The outer-shell M1' is a conductor made of, for example, a metal, but the disclosure is not limited thereto. The dielectric material M2' is, for example, a plastic material, such as polyethylene, polycarbonate, polytetrafluoroethylene, or other appropriate dielectric materials, and the disclosure is not limited thereto. In addition, the waveguide tube structure 534*c* may become a hollow structure by not filling the dielectric material M2' into the outer-shell M1', which is not particularly limited in the disclosure. FIG. 21 illustrates a dielectric waveguide structure plugged to the shell of FIG. 18. As similar to the dielectric waveguide structure 136 in the embodiment of FIG. 12, in FIG. 21, the dielectric waveguide structure 536*a* may be plugged to the shell 532*b* depicted in the embodiment of FIG. 18, and the shell 532*b* may transceive the signal through the dielectric waveguide structure 536*a*.

Numbers of the dielectric base, the pin set, the circuit and the mode-converting structure as well as a number of the waveguide constituted by the shell are not limited in the disclosure. Details regarding the same are described below with reference to the drawing.

Figure 22:
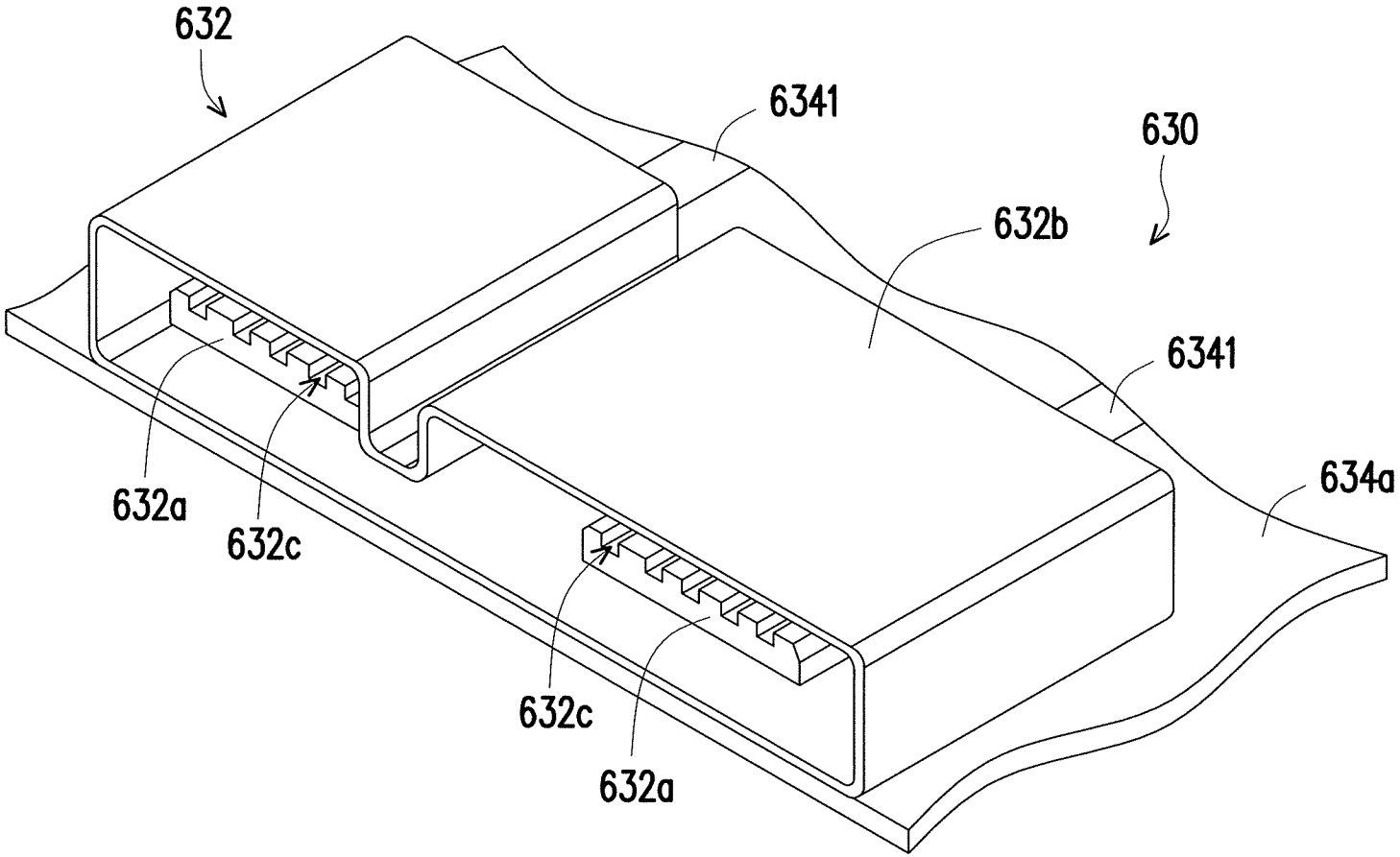
FIG. 22 is a 3D diagram of a connector in accordance with another embodiment of the disclosure.
Figure 23:
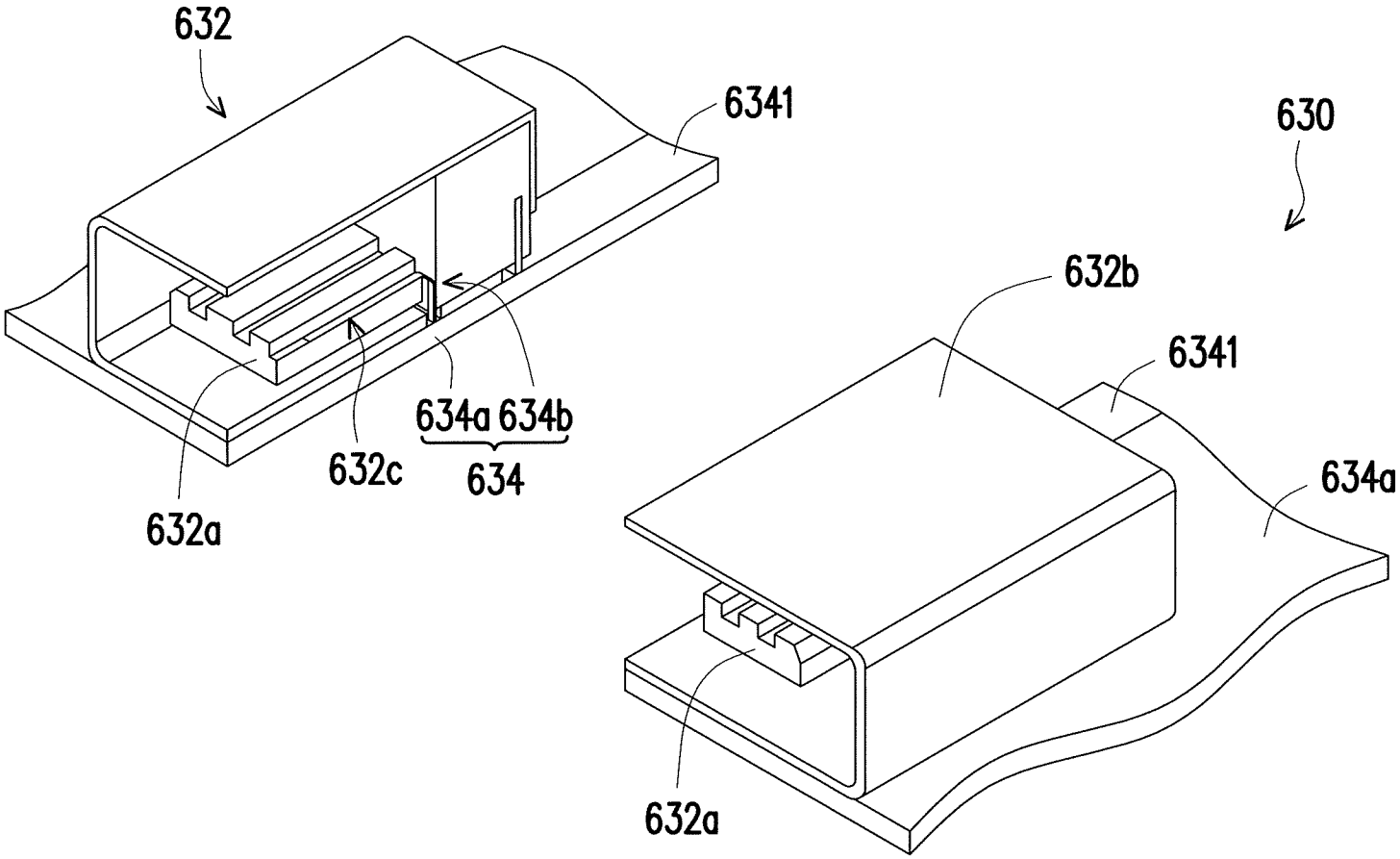
FIG. 23 is a 3D diagram of a partial structure of the connector of FIG. 22.
Figure 24:
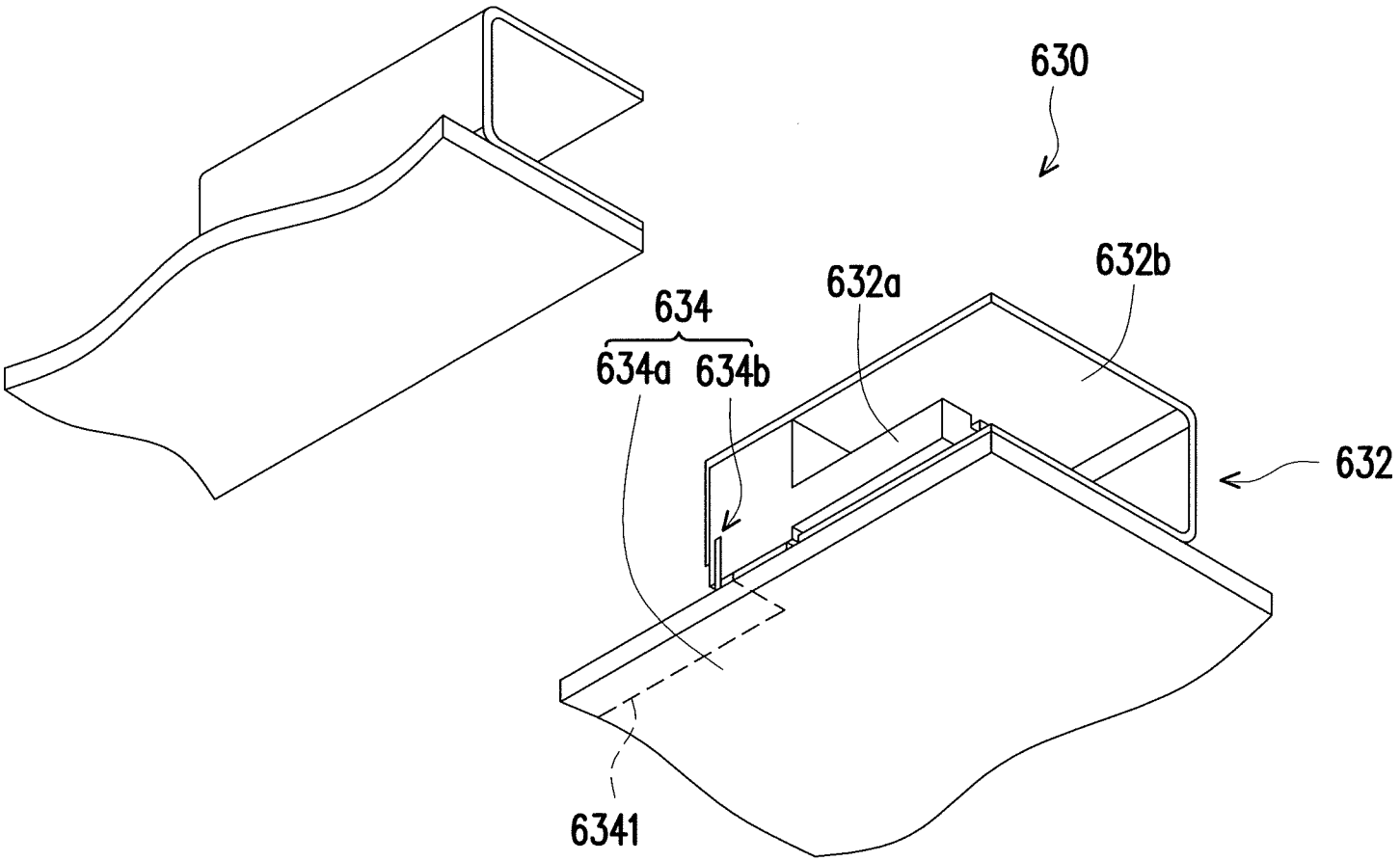
FIG. 24 is a 3D diagram of the connector of FIG. 23 from another perspective.

FIG. 22 is a 3D diagram of a connector in accordance with another embodiment of the disclosure. FIG. 23 is a 3D diagram of a partial structure of the connector of FIG. 22. FIG. 24 is a 3D diagram of the connector of FIG. 23 from another perspective. Referring to FIG. 22 to FIG. 24, a connector 630 of the present embodiment is, for example, a micro USB 3.0 connector. In the connector 630 of the present embodiment, dispositions and actions of a first connector body 632, a dielectric base 632*a*, a shell 632*b*, a pin set 632*c*, a mode-converting unit 634, a substrate 634*a*, a circuit 6341 and a mode-converting structure 634*b* are similar to dispositions and actions of the first connector body 532, the dielectric base 532*a*, the shell 532*b*, the pin set 532*c*, the mode-converting unit 534, the substrate 534*a*, the circuit 5341 and the mode-converting structure 534*b* depicted in FIG. 16 and FIG. 17, and the mode-converting unit may also be integrated in the connector as the foregoing embodiments, thus related descriptions thereof are omitted hereinafter. A difference between the connector 630 and the connector 530 is that, numbers of the at least one dielectric base 632*a*, the at least one pin set 632*c*, the at least one circuit 6341, the at least one mode-converting structure 634*b* and the at least one waveguide tube constituted by the shell 632*b* are all plural (herein, two are illustrated), so as to constitute a plurality of signal transmission paths.

Figure 25:
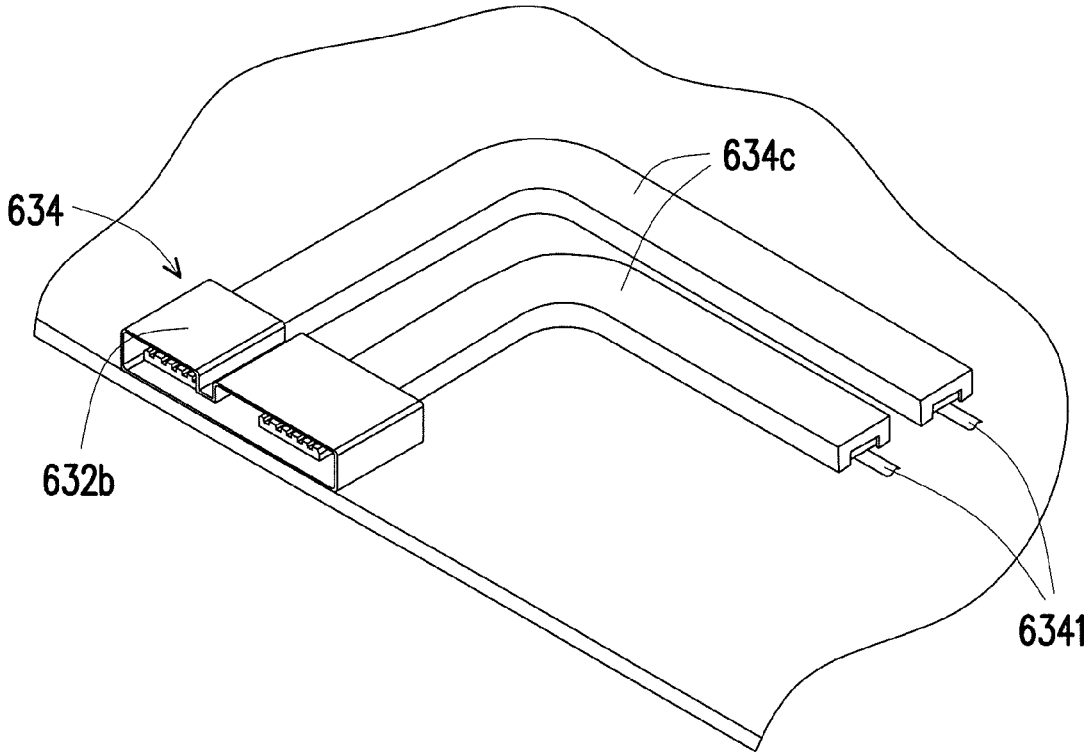
FIG. 25 is a partial 3D diagram of a connector and a circuit board in accordance with another embodiment of the disclosure.

In the embodiments of FIG. 22 to FIG. 24, if the signal transceiver module is relatively farther from the shell of the connector, a waveguide tube structure may be disposed between the connector and the circuit to increase a signal transmission efficiency thereof, and related details are described below. FIG. 25 is a partial 3D diagram of a connector and a circuit board in accordance with another embodiment of the disclosure. Differences between the embodiment depicted in FIG. 25 and the embodiments depicted in FIG. 22 to FIG. 24 are that, in FIG. 25, the mode-converting unit 634 further includes two waveguide tube structures 634*c*; and the waveguide tube structures 634*c* are connected between the shell 632*b* and the circuit 6431, so that the millimeter-wave signal may be transmitted through the waveguide tube structures 634*c*. In particular, a connecting method and a material of the waveguide tube structures 634*c* are similar to a connecting method and a material of waveguide tube structure 134*c* or the waveguide tube structure 534*c*, thus related descriptions thereof is omitted hereinafter. By doing so, degrees of freedom in space disposition of the circuit board may be increased, and a physical length for the millimeter-wave signal to transmit through a planar or a coaxial millimeter waveguide (e.g., the circuit 6341) may also be reduced by disposing the waveguide tube structures 634*c*, so as to reduce losses in the transmission of the millimeter-wave signal.

Figure 26:
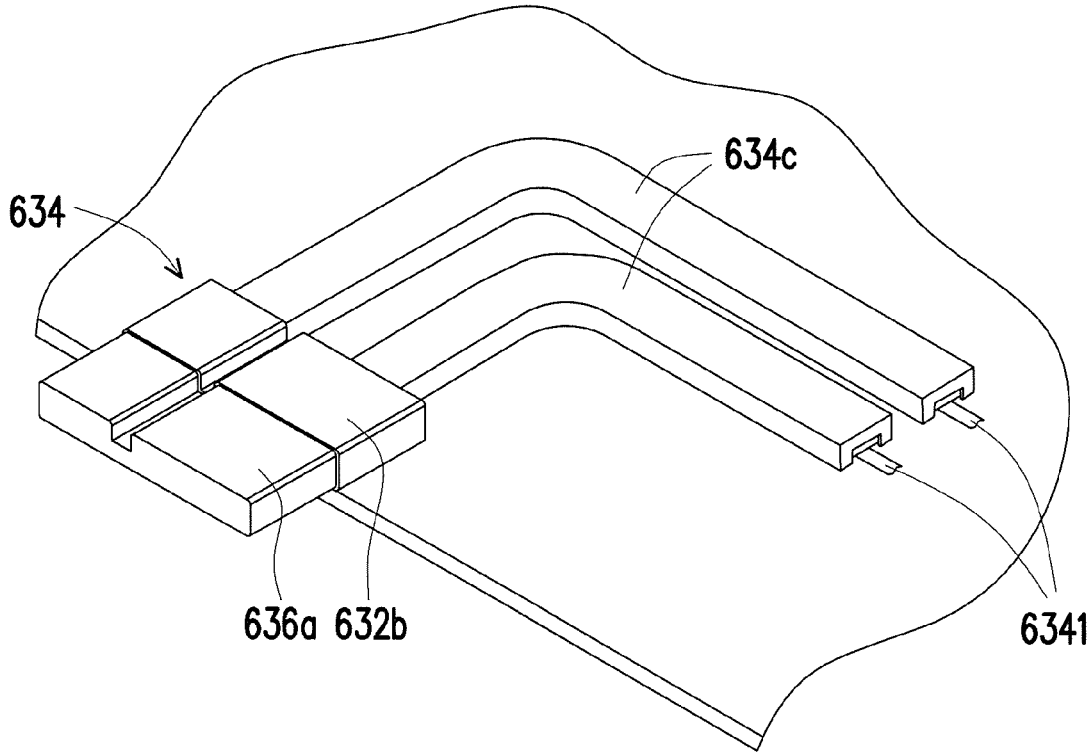
FIG. 26 illustrates a dielectric waveguide structure plugged to the shell of FIG. 25.
Figure 27:
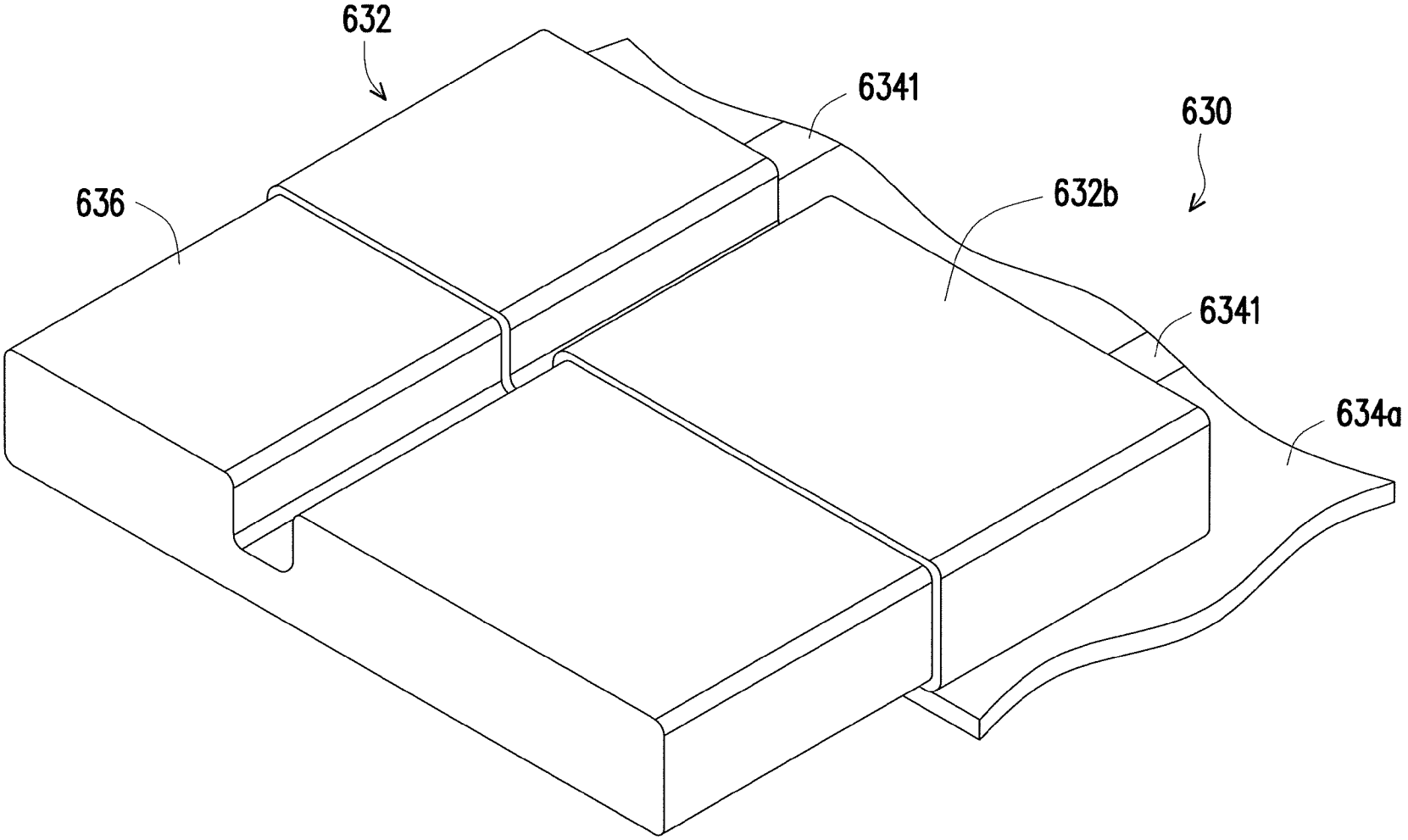
FIG. 27 illustrates a dielectric waveguide structure plugged to the first connector body of FIG. 22.

FIG. 26 illustrates a dielectric waveguide structure plugged to the shell of FIG. 25. Similar to the dielectric waveguide structure 136 in the embodiment of FIG. 12, in FIG. 26, the dielectric waveguide structure 636*a* may be plugged to the shell 632*b* depicted in the embodiment of FIG. 25, and the shell 632*b* may transceive the signal through the dielectric waveguide structure 636*a*. FIG. 27 illustrates a dielectric waveguide structure plugged to the first connector body of FIG. 22. The first connector body 132 similar to that depicted in FIG. 12 may be plugged to the dielectric waveguide structure 136 to improve the signal transceiving capability. The first connector body 632 depicted in FIG. 27 may be plugged to the dielectric waveguide structure 636 to improve the signal transceiving capability. In addition, based on a shape of the shell of the first connector body 632, in other embodiments, the dielectric waveguide structure may have other appropriate shapes, and the disclosure is not limited thereto.

Figure 28:
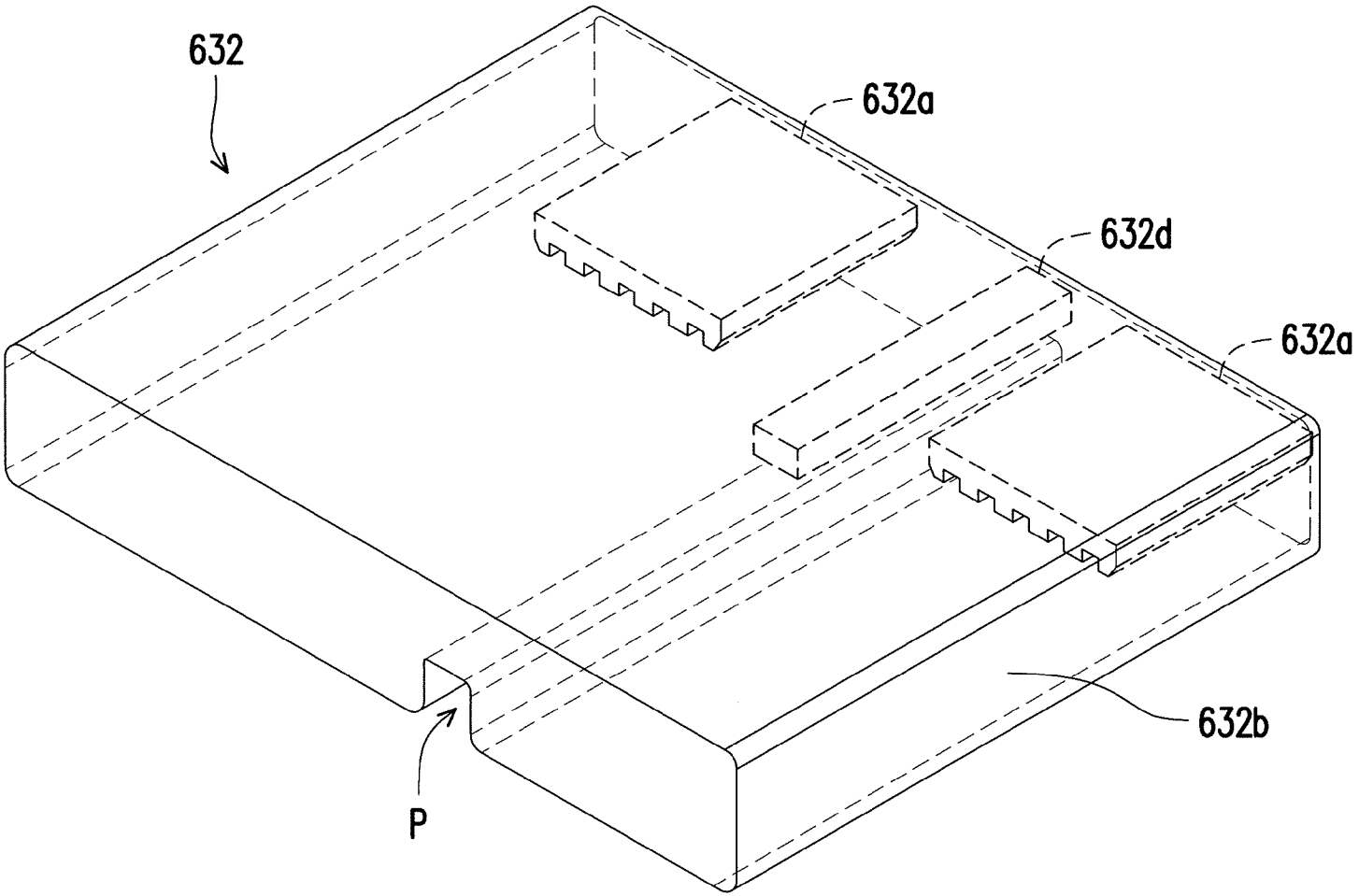
FIG. 28 illustrates a conductive pillar embedded in the shell of FIG. 27.

As shown in FIG. 28, a conductive pillar 632*d* may be embedded in the height-reducing portion P of the shell 632*b* to increase the isolation between the two waveguide tubes constituted by the shell 632*b*. The conductive pillar 632*d* is a conductor made of, for example, a metal, but the disclosure is not limited thereto.

Although the foregoing embodiments are illustrated by using the USB connector as examples, the disclosure is not limited thereto. In other embodiments, the mode-converting unit integrated in an audio connector or connectors in other types may also be used. Details regarding the same are described below with reference to the drawing.

Figure 29:
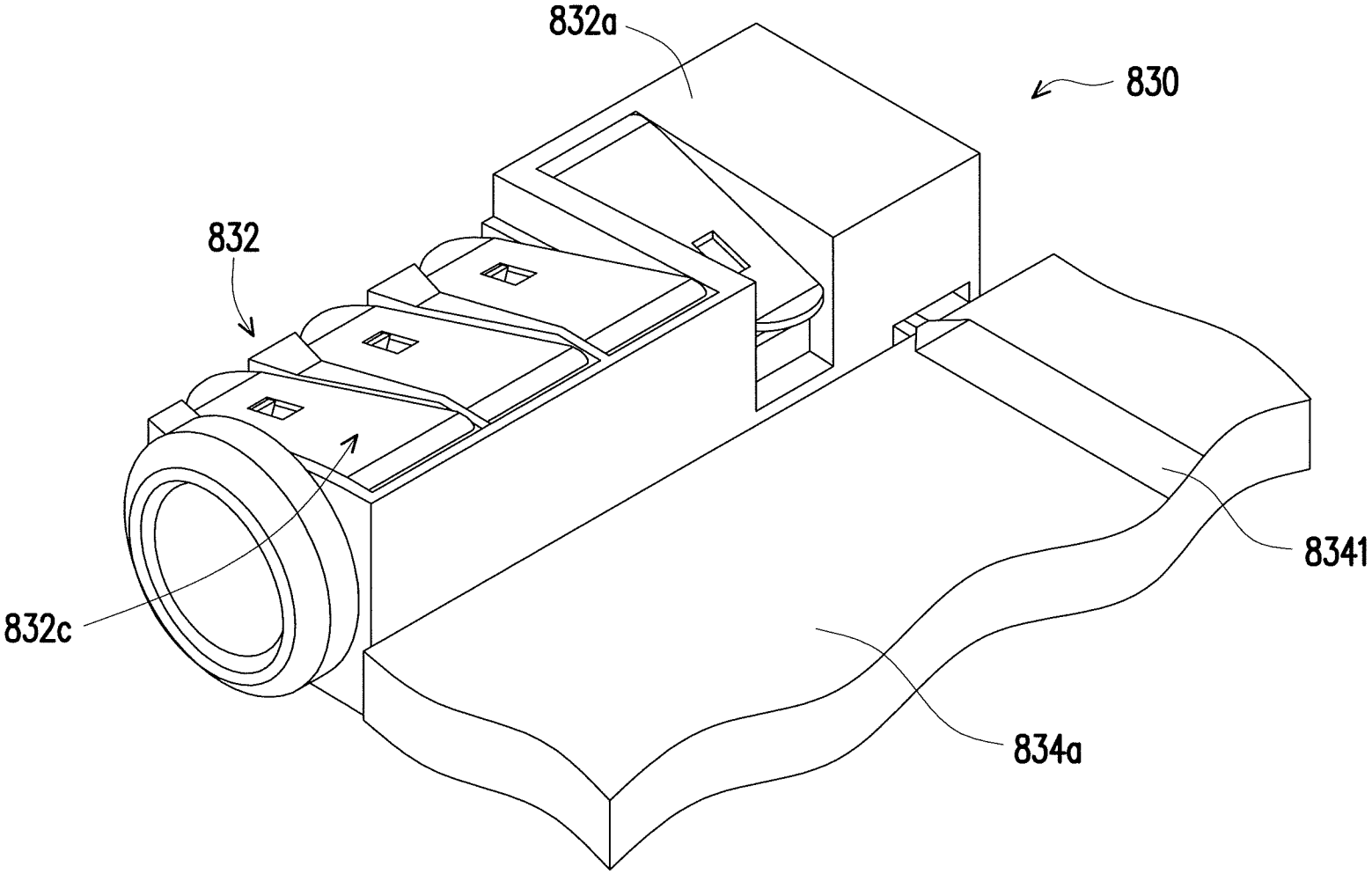
FIG. 29 is a 3D diagram of a connector in accordance with another embodiment of the disclosure.
Figure 30:
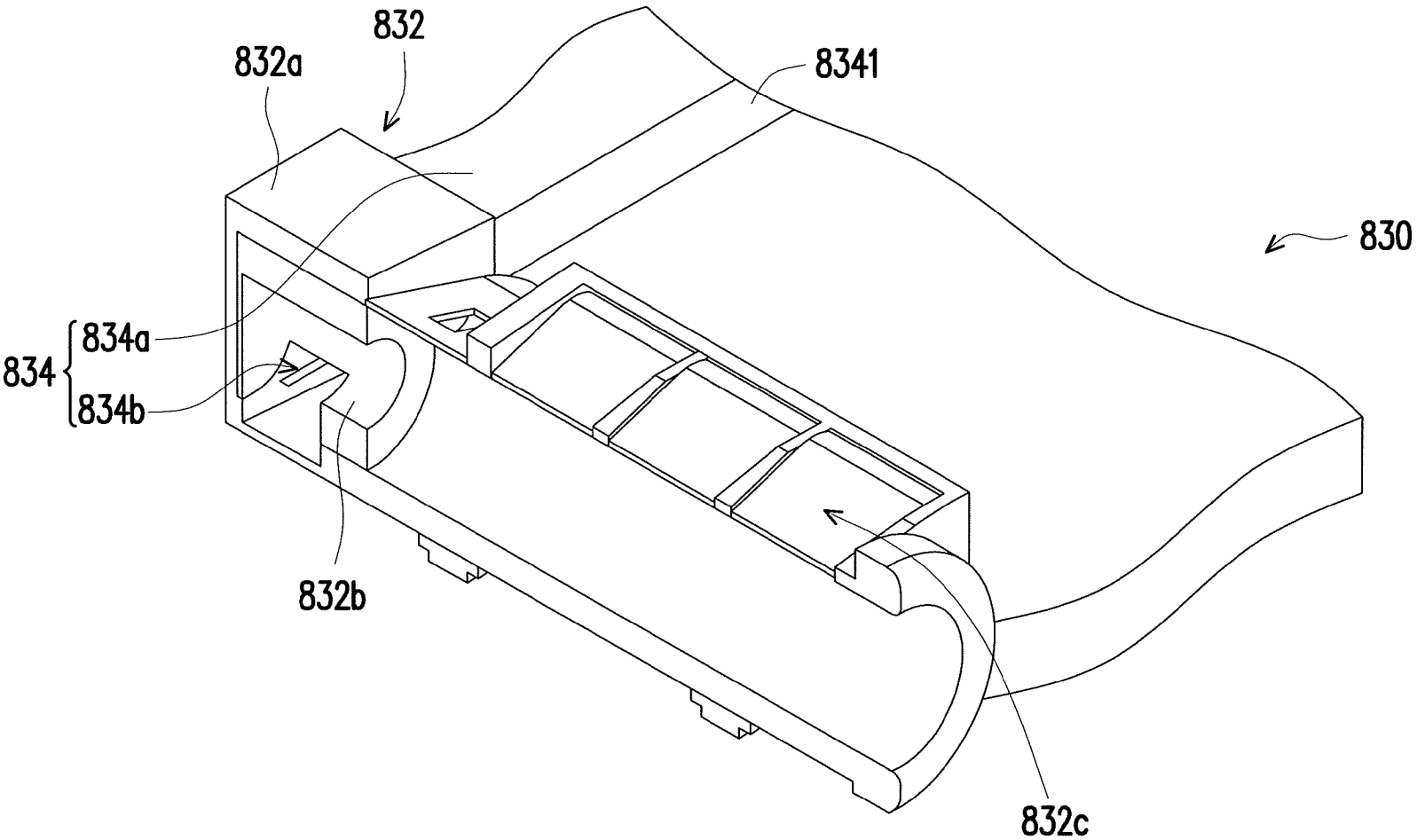
FIG. 30 is a 3D diagram of a partial structure of the connector of FIG. 29.

FIG. 29 is a 3D diagram of a connector in accordance with another embodiment of the disclosure. FIG. 30 is a 3D diagram of a partial structure of the connector of FIG. 29. Referring to FIG. 29 to FIG. 30, a first connector body 832 is an audio connecting interface instead of the USB connector. Therein, dispositions and actions of the first connector body 832, a dielectric base 832*a*, a shell 832*b*, a pin set 832*c*, a mode-converting unit 834, a substrate 834*a*, a circuit 8341 and a mode-converting structure 834*b* are similar to dispositions and actions of the first connector body 532, the dielectric base 532*a*, the shell 532*b*, the pin set 532*c*, the mode-converting unit 534, the substrate 534*a*, the circuit 5341 and the mode-converting structure 534*b* depicted in FIG. 5 and FIG. 6, and the mode-converting unit may also be integrated in the connector as the foregoing embodiments, thus related descriptions thereof are omitted hereinafter.

Figure 31:
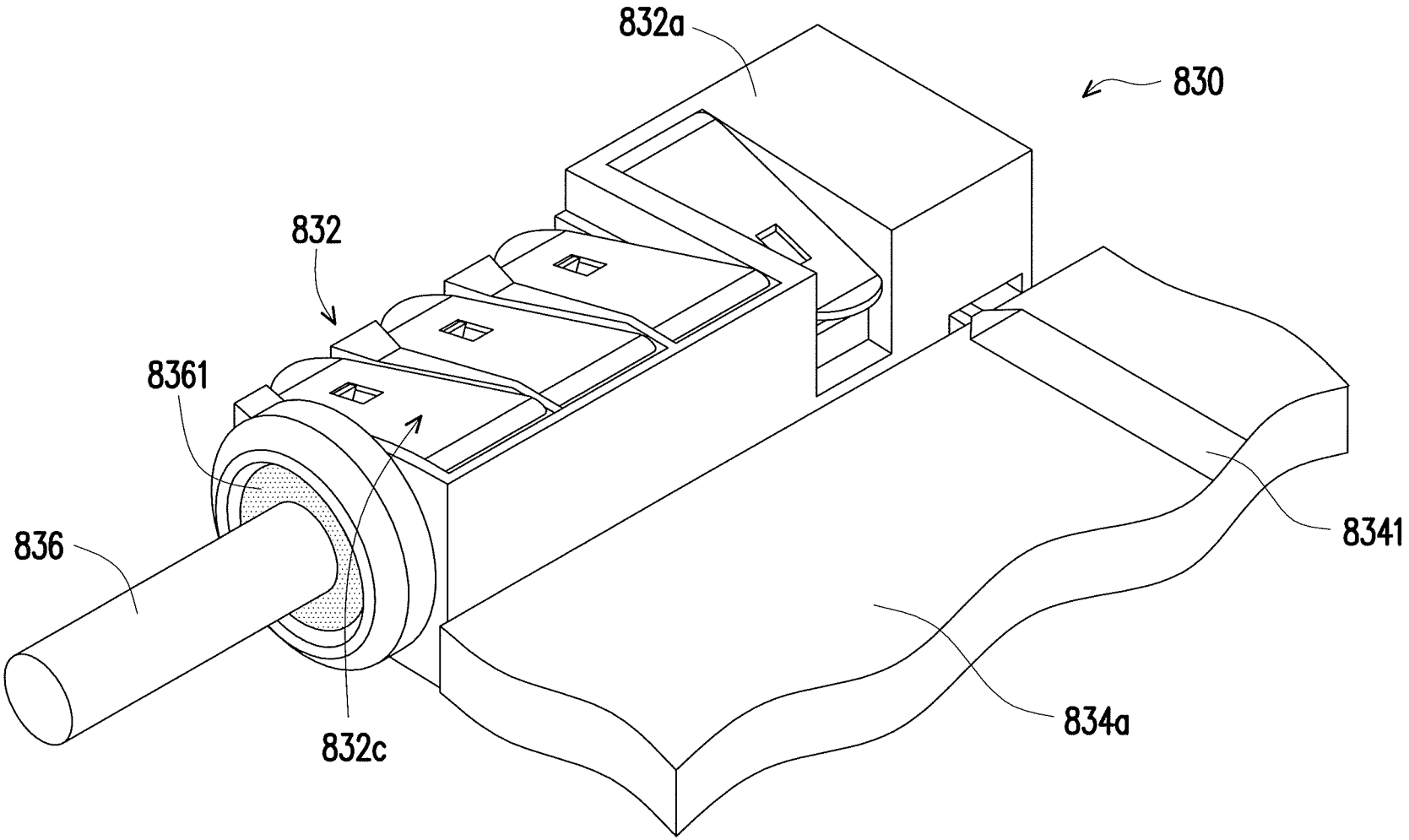
FIG. 31 illustrates a dielectric waveguide structure plugged to the first connector body of FIG. 27.
Figure 32:
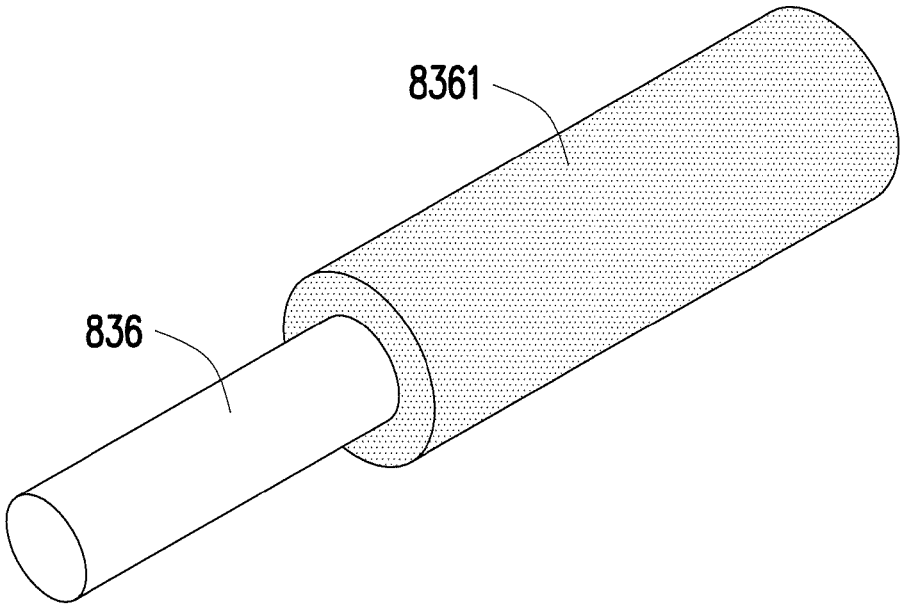
FIG. 32 is a 3D diagram of the dielectric waveguide structure of FIG. 31.

FIG. 31 illustrates a dielectric waveguide structure plugged to the first connector body of FIG. 29. FIG. 32 is a 3D diagram of the dielectric waveguide structure of FIG. 31. As shown in FIG. 31, the first connector body 832 depicted in FIG. 19 may be plugged to the dielectric waveguide structure 836 to improve the signal transceiving capability. In addition, in case the shell 832*b* of the connector 830 is relatively smaller in size as shown in FIG. 30, a conductive layer 8361 may cover on a portion of the dielectric waveguide structure 836 as shown in FIG. 32, so as to achieve an effect of waveguide tube by utilizing the conductive layer 8361.

Figure 33A:
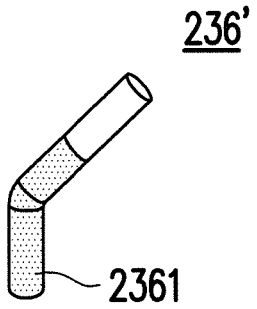
FIG. 33A to FIG. 33C are 3D diagrams of dielectric waveguide structures in accordance with other embodiments of the disclosure.
Figure 33B:
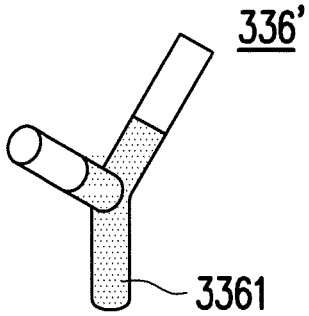
Figure 33C:
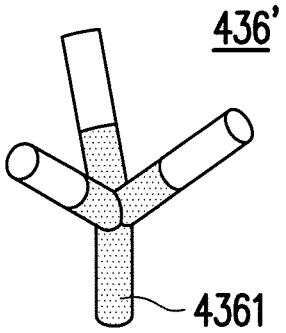

In other embodiments, the effect of the waveguide tube may also be achieved by the conductive layer covering on a portion of the dielectric waveguide structure in various shapes. Details regarding the same are described below with reference to the drawing. FIG. 33A to FIG. 33C are 3D diagrams of dielectric waveguide structures in accordance with other embodiments of the disclosure. Dispositions and actions of a dielectric waveguide structure 236', a dielectric waveguide structure 336' and a dielectric waveguide structure 436' depicted in FIG. 33A to FIG. 33C are respectively similar to dispositions and actions of the dielectric waveguide structure 236, the dielectric waveguide structure 336 and the dielectric waveguide structure 436 depicted in FIG. 14A to FIG. 14C. Differences between the dielectric waveguide structure 236', the dielectric waveguide structure 336' and a dielectric waveguide structure 436', and the dielectric waveguide structure 236, the dielectric waveguide structure 336 and the dielectric waveguide structure 436 are that, a conductive layer 2361, a conductive layer 3361 and a conductive layer 4361 cover on a portion of the dielectric waveguide structure 236', a portion of the dielectric waveguide structure 336' and a portion of the dielectric waveguide structure 436', so as to achieve the effect of the waveguide tube, respectively.

Figure 34:
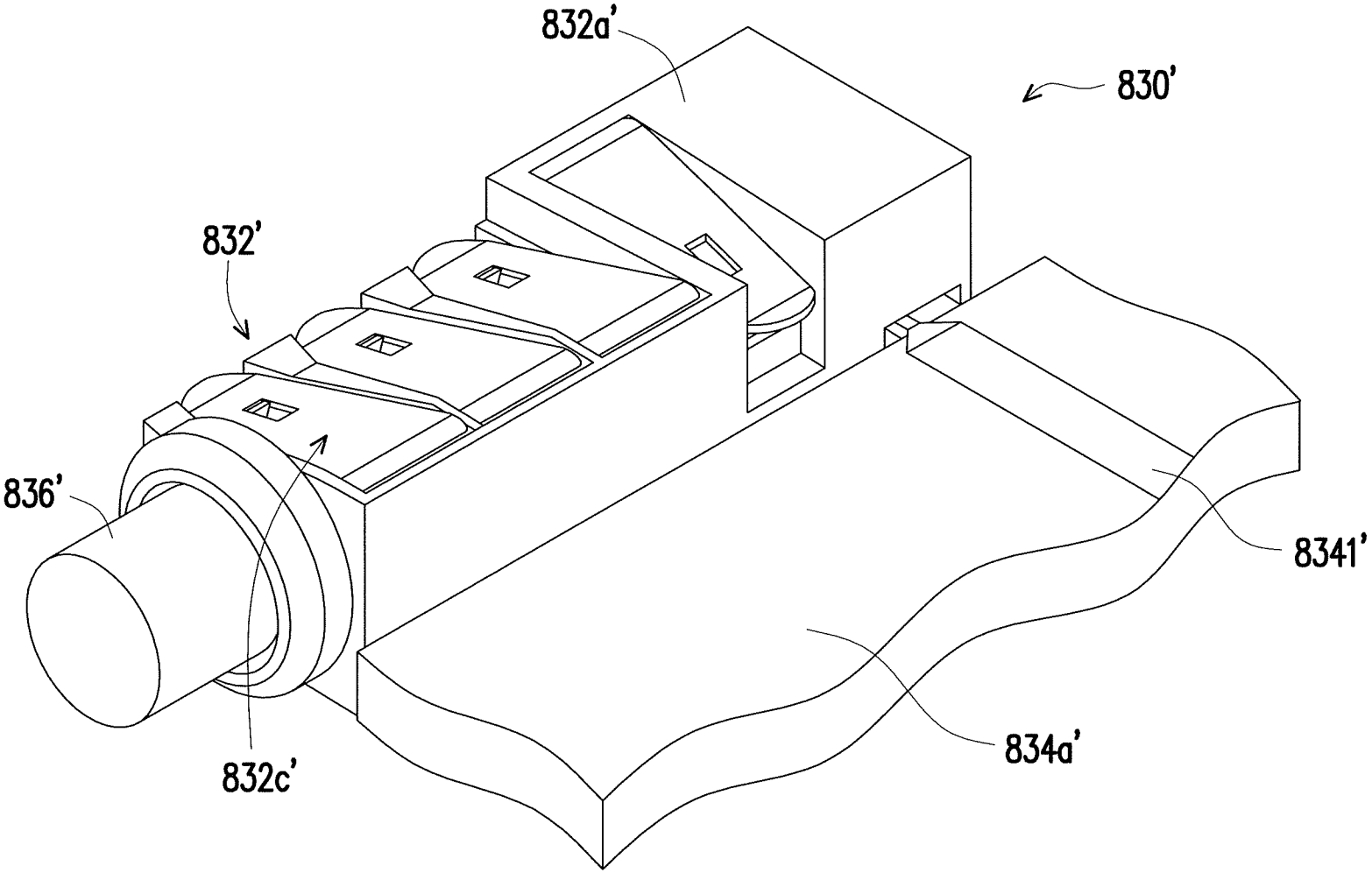
FIG. 34 is a 3D diagram of a connector in accordance with another embodiment of the disclosure.
Figure 35:
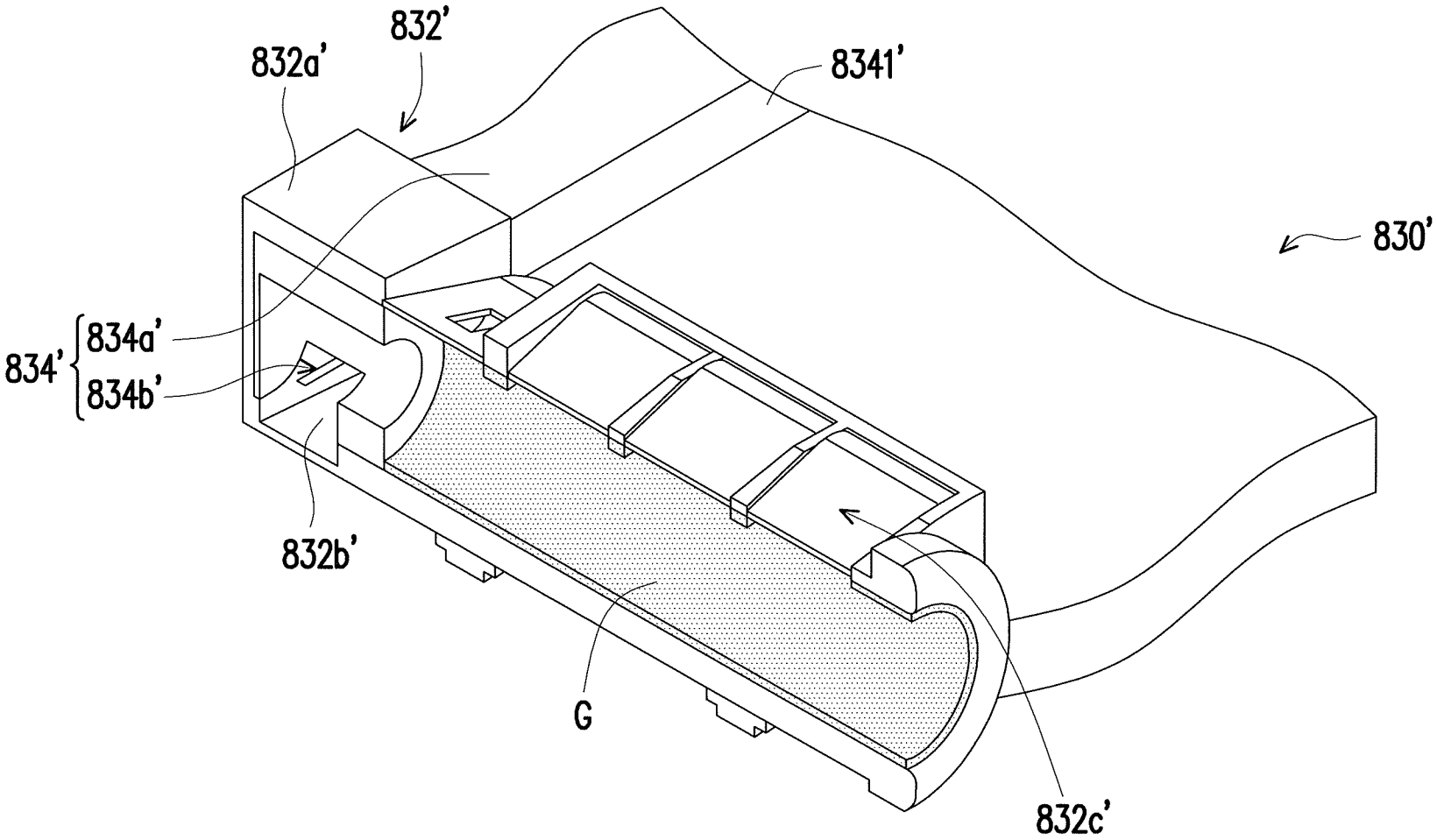
FIG. 35 is a 3D diagram of a partial structure of the connector of FIG. 34.

FIG. 34 is a 3D diagram of a connector in accordance with another embodiment of the disclosure. FIG. 35 is a 3D diagram of a partial structure of the connector of FIG. 34. Referring to FIG. 34 and FIG. 35, in a connector 830' of the present embodiment, dispositions and actions of a first connector body 832', a dielectric base 832*a*', a shell 832*b*', a pin set 832*c*', a mode-converting unit 834', a substrate 834*a*', a circuit 8341' and a mode-converting structure 834*b*' are similar to dispositions and actions of the first connector body 832, the dielectric base 832*a*, the shell 832*b*, the pin set 832*c*, the mode-converting unit 834, the substrate 834*a*, the circuit 8341 and the mode-converting structure 834*b* depicted in FIG. 29 to FIG. 31, and the mode-converting unit may also be integrated in the connector as the foregoing embodiments, thus related descriptions thereof are omitted hereinafter. A difference between the connector 830' and the connector 830 is that, a waveguide tube G is disposed additionally in the dielectric base 832', and the waveguide tube G is adjacent to the shell 832*b*' to solve the problem of the shell 832*b*' being insufficient in size. When the dielectric waveguide structure 836' is plugged to the first connector body 832 as shown in FIG. 34, the dielectric waveguide structure 836' is partially covered by the metal waveguide tube G, thus it is not required to cover the conductive layer on a surface of the dielectric waveguide structure 836 as shown in FIG. 31 and FIG. 32.

Figure 36:
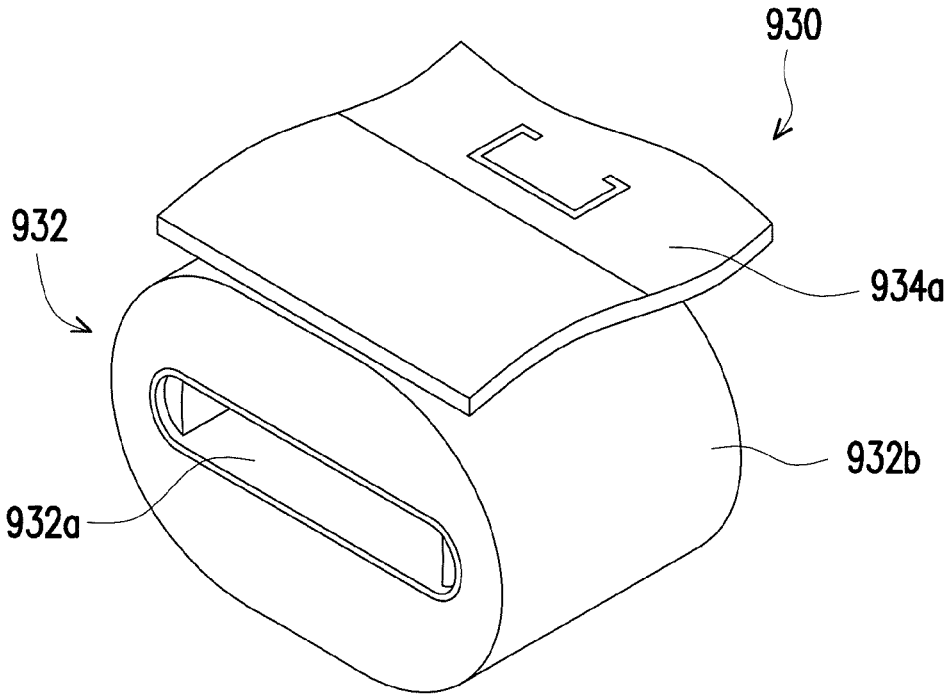
FIG. 36 is a 3D diagram of a connector in accordance with another embodiment of the disclosure.
Figure 37:
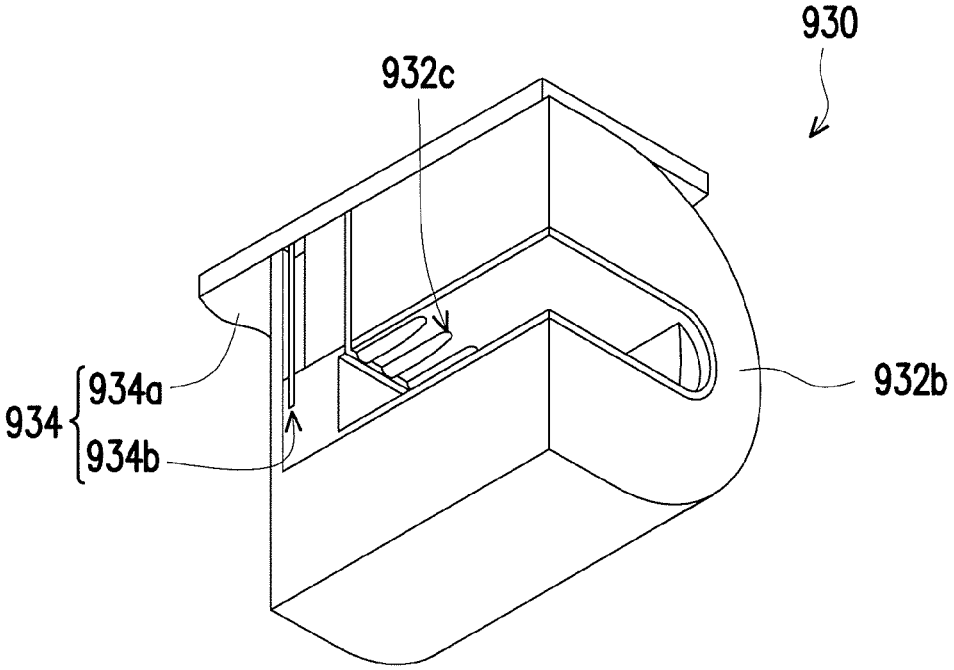
FIG. 37 is a 3D diagram of a partial structure of the connector of FIG. 36.
Figure 38:
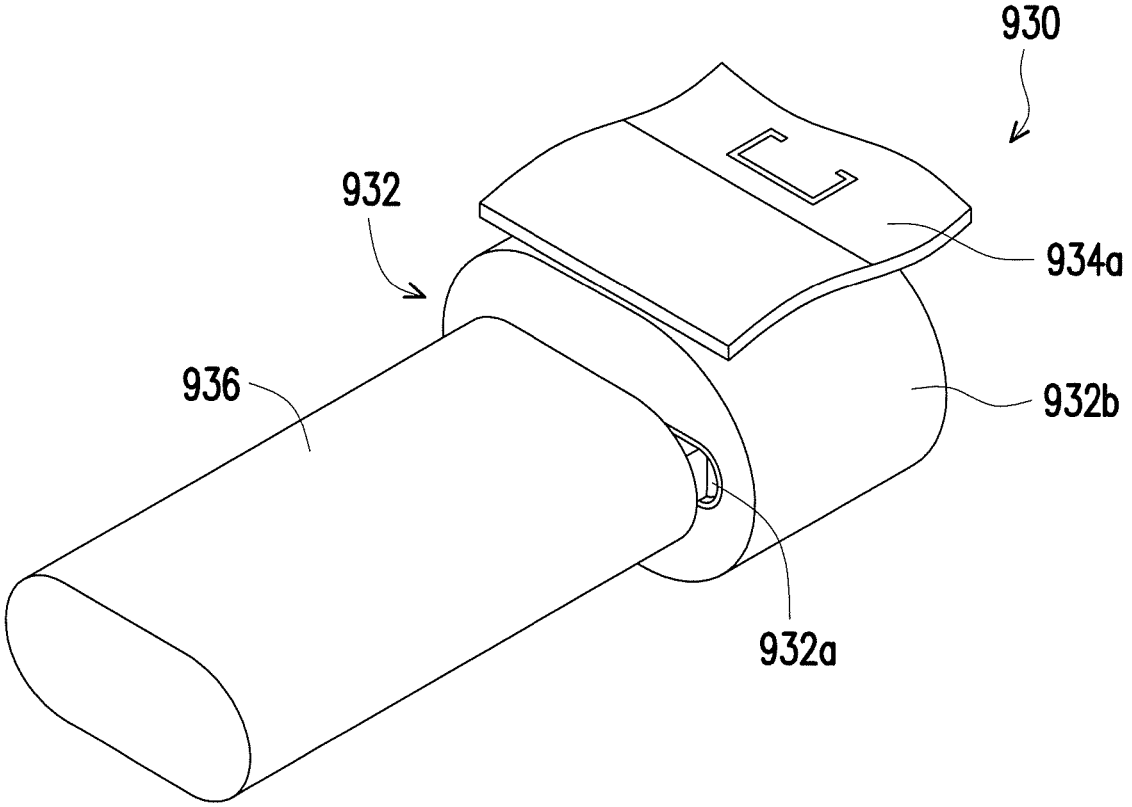
FIG. 38 illustrates a dielectric waveguide structure plugged to the first connector body of FIG. 37.

FIG. 36 is a 3D diagram of a connector in accordance with another embodiment of the disclosure. FIG. 37 is a 3D diagram of a partial structure of the connector of FIG. 36. FIG. 38 illustrates a dielectric waveguide structure plugged to the first connector body of FIG. 37. Referring to FIG. 36 to FIG. 38, a first connector body 932 is a data transmission connecting interface in other formats (herein, it illustrated with a Lightning connecting interface manufactured by Apple, Inc as an example) connecting interface instead of the USB connector. Therein, dispositions and actions of a first connector body 932, a dielectric base 932*a*, a shell 932*b*, a pin set 932*c*, a mode-converting unit 934, a substrate 934*a* and a mode-converting structure 934*b* are similar to dispositions and actions of the first connector body 532, the dielectric base 532*a*, the shell 532*b*, the pin set 532*c*, the mode-converting unit 534, the substrate 534*a* and the mode-converting structure 534*b* depicted in FIG. 16 and FIG. 17; the mode-converting unit may also be integrated in the connector as the foregoing embodiments; and the dielectric waveguide structure 936 may be plugged to the first connector body 932 of the connector 930 to improve the signal transceiving capability as shown in FIG. 38, thus related descriptions thereof are omitted hereinafter.

The connecting interface in various types (e.g., the USB connecting interface, the audio connecting interface and the Lightning connecting interface manufactured by Apple, Inc.) are merely examples. In other embodiments, the mode-converting unit may be integrated in other connecting interface in other formats, so that the shell provided by the connector may serve as the waveguide tube of the mode-converting unit to save the disposing space while improve the signal transceiving capability.

Although it is illustrated with the mode-converting unit being integrated in the connecting interface in the electronic device as examples in the foregoing embodiments, the disclosure is not limited thereto. The mode-converting unit may also be integrated in a connecting interface of an external device, so that the electronic device may transceive the signal through the mode-converting unit of the external device. Details regarding the same are described below with reference to the drawing.

Figure 39:
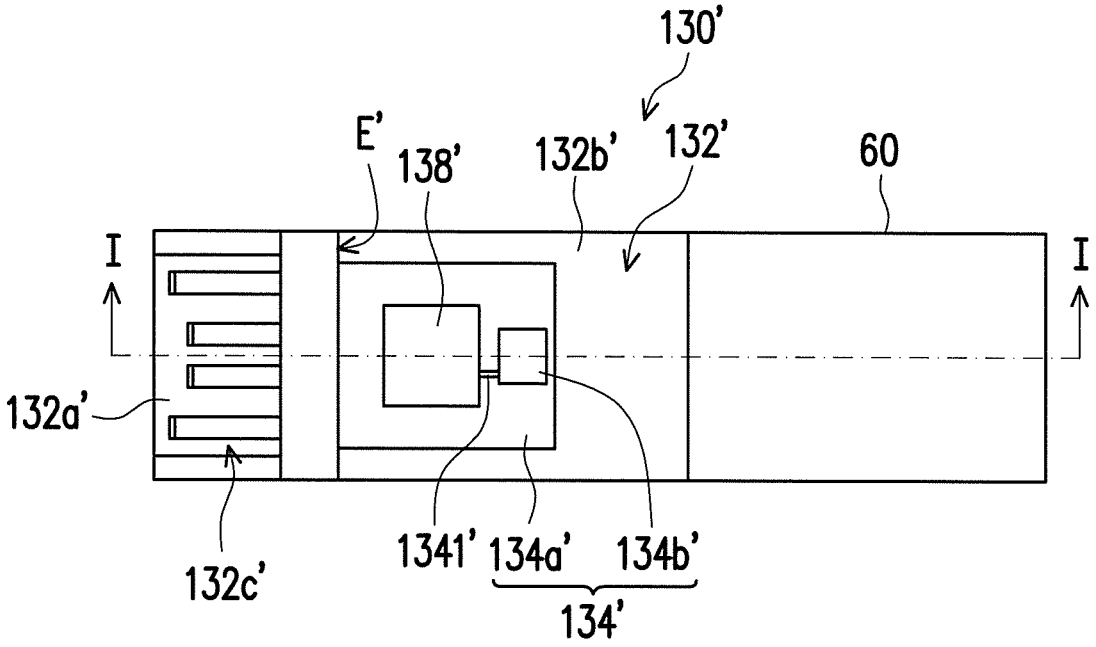
FIG. 39 is a schematic structural diagram of a connector in accordance with another embodiment of the disclosure.
Figure 40:
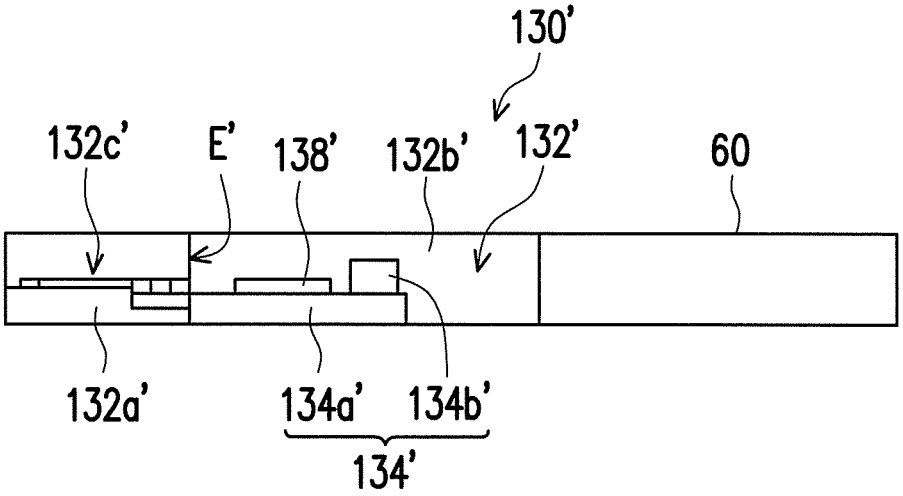
FIG. 40 is a schematic cross-sectional diagram of the connector of FIG. 39 along line I-I'.
Figure 41:
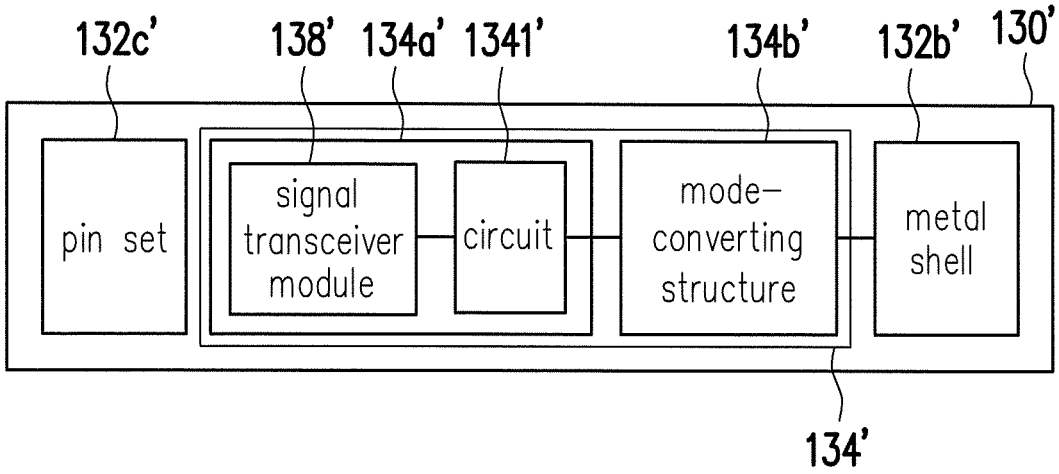
FIG. 41 is a block diagram of the connector of FIG. 39.

FIG. 39 is a schematic structural diagram of a connector in accordance with another embodiment of the disclosure. FIG. 40 is a schematic cross-sectional diagram of the connector of FIG. 39 along line I-I'. FIG. 41 is a block diagram of the connector of FIG. 39. Referring to FIG. 39 to FIG. 41, in a connector 130' of the present embodiment, dispositions and actions of a first connector body 132', a dielectric base 132*a*', a shell 132*b*', a pin set 132*c*', a mode-converting unit 134', a substrate 134*a*', a circuit 1341' and a mode-converting structure 134*b*' are similar to dispositions and actions of the first connector body 132, the dielectric base 132*a*, the shell 132*b*, the pin set 132*c*, the mode-converting unit 134, the substrate 134*a*, the circuit 1341 and the mode-converting structure 134*b* depicted in FIG. 2 and FIG. 3, and the mode-converting unit may also be integrated in the connector as the foregoing embodiments, thus related descriptions thereof are omitted hereinafter. The mode-converting structure 134*b*' depicted in FIG. 39 and FIG. 40 is merely an example, which may be similar to the mode-converting structure 134*b* in form of the slot as depicted in FIG. 2 and FIG. 3, the mode-converting structure 534*b* in form of the probe as depicted in FIG. 14, or mode-converting structures in other appropriate formats. A difference between the connector 130' and the connector 130 is that, the first connector body 132' is a connecting interface of an external device 60; the substrate 134*a*' has a signal transceiver module 138'; the circuit 1341' is connected to the signal transceiver module 138'; and the signal transceiver module 138' is electrically connected to the pin set 132*c*'. The external device 60 is, for example, a wireless network card or external devices in other types, and the disclosure is not limited thereto.

Figure 42:
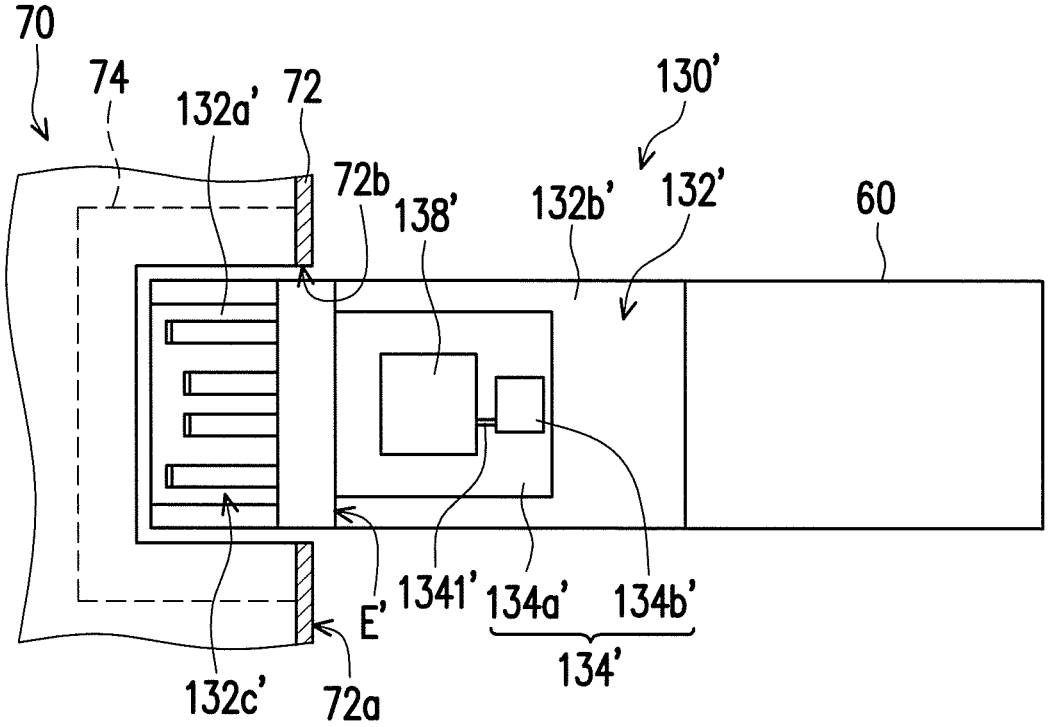
FIG. 42 is a schematic diagram of the external device of FIG. 39 plugged to an electronic device.

FIG. 42 is a schematic diagram of the external device of FIG. 39 plugged to an electronic device. Referring to FIG. 42, an electronic device 70 is, for example, a smart phone or an electronic device in other types, which includes an outer shell 72, and an edge 72*a* of the outer shell 72 has an opening 72*b*. A second connector body 74 is disposed in the outer shell 72 and aligned to the opening 72*b* to become a connecting interface of the electronic device 70. A first connector body 132' of the connector 130 is adapted to be plugged to the second connector body 74 of the electronics device 70 through the opening 74. When the external device 60 is plugged to the second connector body 74 through the first connector body 132', after being received by the shell 132*b*', a signal from the outside is transmitted to the signal transceiver module 138' through the mode-converting structure 134*b*' and the circuit 1341'. After being processed by the signal transceiver module 138', the signal may be transmitted to the electronic device 70 through the pin set 132*c*'. On the other hand, a signal from the electronic device 70 may be transmitted to the signal transceiver module 138' through the pin set 132*c*', and then transmitted to the shell 132*b*' through the circuit 1341' and the mode-converting structure 134*b*' and emitted to the outside. Accordingly, the electronic device 70 may transceive the signal by utilizing the mode-converting unit 134' of the external device 60.

In the present embodiment, the shell 132*b*' is designed to include, for example, a closed end E', so that the signal may be transmitted along the shell 132W in one single direction, thereby preventing an outside signal from directly entering the electronic device 70 through the shell 132W.

Figure 43:
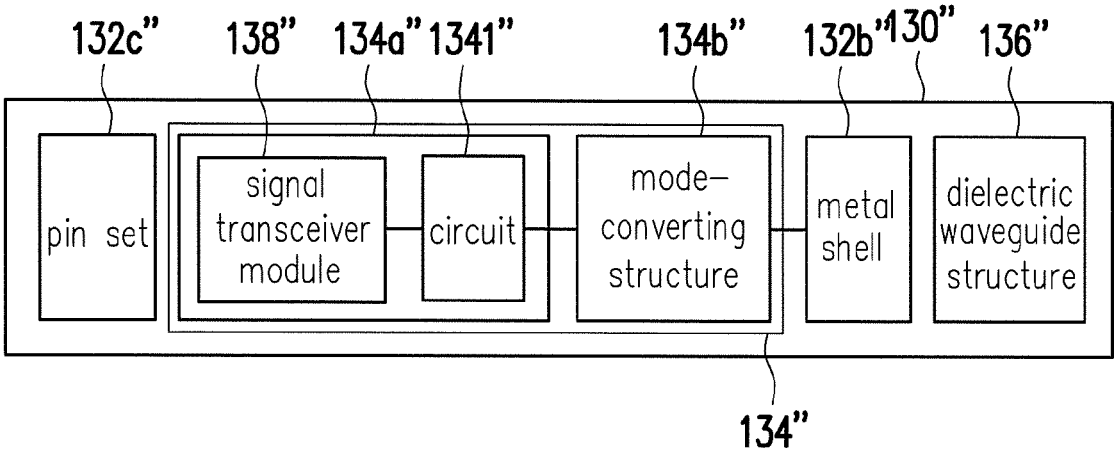
FIG. 43 is a block diagram of a connector in accordance with another embodiment of the disclosure.

FIG. 43 is a block diagram of a connector in accordance with another embodiment of the disclosure. Referring to FIG. 43, in a connector 130" of the present embodiment, dispositions and actions of a shell 132*b*", a pin set 132*c*", a mode-converting unit 134", a substrate 134*a*", a circuit 1341", a mode-converting structure 134*b*" and a signal transceiver module 138" are similar to dispositions and actions of the shell 132*b*', the pin set 132*c*', the mode-converting unit 134', the substrate 134*a*', the circuit 1341', the mode-converting structure 134W and the signal transceiver module 138' depicted in FIG. 41, and the mode-converting unit may also be integrated in the connecting interface of the external device, thus related descriptions thereof are omitted hereinafter. Differences between the connector 130" and the connector 130' are that, the connector 130" further includes a dielectric waveguide structure 136"; the dielectric waveguide structure 136" is a radiator and connected to the shell 132*b*"; and the shell 132W' transceives the signal through the dielectric waveguide structure 136" so as to further improve the signal transceiving capability.

In summary, the connector of the disclosure is integrated with the mode-converting unit, and the shell of the connector constitutes the waveguide tube of the mode-converting unit. Accordingly, the mode-converting unit may successfully transceive the signal without disposing additional waveguide tubes, so that a disposing space may be saved to avoid signal interferences caused by other devices being too closed to the mode-converting unit. In addition, the outer shell of the electronic device is disposed with the opening aligned to the connector, thus the mode-converting unit may also be aligned to the opening without the signal transceiving efficiency being reduced by blocking of the outer shell, and the user may combine the dielectric waveguide structure to the shell of the connector through the opening, so as to improve the signal transceiving capability. In addition, since the connector is disposed adjacent to the edge of the outer shell of the electronic device instead of being disposed on a back surface of the outer shell, the mode-converting unit being integrated in the connector may transceive the signal in a more preferable direction so as to further increase the signal transceiving efficiency. Furthermore, since the mode-converting unit is disposed adjacent to the edge of the outer shell of the electronic device, when the user holds the electronic device, the mode-converting unit may still maintain a favorable signal transceiving capability without being blocked by a hand portion of the user.

Although the present disclosure has been described with reference to the above embodiments, it is apparent to one of the ordinary skill in the art that modifications to the described embodiments may be made without departing from the spirit of the present disclosure. Accordingly, the scope of the present disclosure will be defined by the attached claims not by the above detailed descriptions.

What is claimed is:

1. A connector, comprising:

a first connector body comprising:

at least one dielectric base;

a shell, the shell and the dielectric base being fixed to each other; and at least one pin set disposed on the dielectric base and configured to connect a second connector body; and a mode-converting unit comprising:

a substrate fixed to the first connector body and having at least one circuit; and at least one mode-converting structure, the shell constituting at least one waveguide tube of the mode-converting unit and configured to transceive a signal, the circuit and the shell being coupled to each other through the mode-converting structure, and the signal being transmitted from the shell to the circuit through the mode-converting structure, or transmitted from the circuit to the shell through the mode-converting structure and emitted outward, wherein the signal is a millimeter-wave signal, and a section of an opening of the shell is related to a cut-off frequency of the shell.

2. The connector of claim 1, wherein the connector is adapted to an electronic device, the electronic device comprises an outer shell and a circuit board, an edge of the outer shell has an opening, the first connector body is disposed in the outer shell and aligned to the opening to become a connecting interface of the electronic device, the second connector body is a connecting interface of an external device and adapted to be plugged to the first connector body through the opening, the circuit board is disposed in the outer shell and has a signal transceiver module, the substrate is a part of the circuit board, and the circuit is connected to the signal transceiver module.

3. The connector of claim 2, wherein the first connector body is a universal serial bus connecting interface or an audio connecting interface.

4. The connector of claim 2, further comprising a dielectric waveguide structure, wherein the dielectric waveguide structure is configured to be plugged to the first connector body through the opening, and the shell transceives the signal through the dielectric waveguide structure.

5. The connector of claim 4, wherein a conductive layer covers a portion of a surface of the dielectric waveguide structure.

6. The connector of claim 4, wherein an end of the dielectric waveguide structure is configured to be plugged to the first connector body, and another end of the dielectric waveguide structure has one or more bent portions.

7. The connector of claim 1, wherein the shell has a slot to constitute the mode-converting structure, and the slot is aligned to an end of the circuit.

8. The connector of claim 7, wherein the mode-converting unit further comprises a waveguide tube structure, a grounding plane of the substrate has another slot, the waveguide tube structure is connected between the slot of the shell and the another slot of the grounding plane, and the circuit is aligned to the another slot.

9. The connector of claim 1, wherein an end of the circuit has a probe structure to constitute the mode-converting structure.

10. The connector of claim 9, wherein the mode-converting unit further comprises a waveguide tube structure connected between the shell and the probe structure.

11. The connector of claim 1, wherein the connector is adapted to an electronic device, the electronic device comprises an outer shell, an edge of the outer shell has an opening, the second connector body is disposed in the outer shell and aligned to the opening to become a connecting interface of the electronic device, the first connector body is a connecting interface of an external device and adapted to be plugged to the second connector body through the opening, the substrate has a signal transceiver module, and the circuit is connected to the signal transceiver module.

12. The connector of claim 1, further comprising a dielectric waveguide structure, wherein the dielectric waveguide structure is connected to the shell, and the shell transceives the signal through the dielectric waveguide structure.

13. The connector of claim 1, wherein the shell has a closed end.

14. The connector of claim 1, wherein the shell constitutes one or more waveguide tube structures.

15. An antenna, comprising:

a mode-converting unit comprising:

a substrate having at least one circuit;

at least one waveguide tube configured to transceive a signal, wherein the signal is a millimeter-wave signal, and a section of an opening of the waveguide tube is related to a cut-off frequency of the waveguide tube; and at least one mode-converting structure, the circuit and the waveguide tube being electromagnetically coupled to each other through the mode-converting structure, the signal being transmitted from the waveguide tube to the circuit through the mode-converting structure, or transmitted from the circuit to the waveguide tube through the mode-converting structure and emitted outward; and a first connector body comprising:

at least one dielectric base, and the waveguide tube constituting a shell of the first connector body and fixed to the dielectric base; and a pin set disposed on the dielectric base and configured to connect a second connector body.

16. The antenna of claim 15, wherein the antenna is adapted to an electronic device, the electronic device comprises an outer shell and a circuit board, an edge of the outer shell has an opening, the first connector body is disposed in the outer shell and aligned to the opening to become a connecting interface of the electronic device, the second connector body is a connecting interface of an external device and adapted to be plugged to the first connector body through the opening, the circuit board is disposed in the outer shell and has a signal transceiver module, the substrate is a part of the circuit board, and the circuit is connected to the signal transceiver module.

17. The antenna of claim 16, wherein the first connector body is a universal serial bus connecting interface or an audio connecting interface.

18. The antenna of claim 16, further comprising a dielectric waveguide structure, wherein the dielectric waveguide structure is configured to be plugged to the first connector body through the opening, and the waveguide tube transceives the signal through the dielectric waveguide structure.

19. The antenna of claim 18, wherein a conductive layer covers a portion of a surface of the dielectric waveguide structure.

20. The antenna of claim 18, wherein an end of the dielectric waveguide structure is configured to be plugged to the first connector body, and another end of the dielectric waveguide structure has one or more bent portions.

21. The antenna of claim 15, wherein the waveguide tube has a slot to constitute the mode-converting structure, and the slot is aligned to an end of the circuit.

22. The antenna of claim 21, wherein the mode-converting unit further comprises a waveguide tube structure, a grounding plane of the substrate has another slot, the waveguide tube structure is connected between the slot of the waveguide tube and the another slot of the grounding plane, and the circuit is aligned to the another slot.

23. The antenna of claim 15, wherein an end of the circuit has a probe structure to constitute the mode-converting structure.

24. The antenna of claim 23, wherein the mode-converting unit further comprises a waveguide tube structure connected between the waveguide tube and the probe structure.

25. The antenna of claim 15, wherein the antenna is adapted to an electronic device, the electronic device comprises an outer shell, an edge of the outer shell has an opening, the second connector body is disposed in the outer shell and aligned to the opening to become a connecting interface of the electronic device, the first connector body is a connecting interface of an external device and adapted to be plugged to the second connector body through the opening, the substrate has a signal transceiver module, and the circuit is connected to the signal transceiver module.

26. The antenna of claim 15, further comprising a dielectric waveguide structure, wherein the dielectric waveguide structure is connected to the waveguide tube, and the waveguide tube transceives the signal through the dielectric waveguide structure.

27. The antenna of claim 15, wherein the waveguide has a closed end.

28. The antenna of claim 15, wherein the waveguide tube constitutes one or more waveguide tube structures.

29. An electronic device, comprising:

an outer shell, an edge of the outer shell having an opening;

a circuit board disposed in the outer shell and having a signal transceiver module;

a first connector body disposed in the outer shell and aligned to the opening to become a connecting interface of the electronic device, wherein the first connector body comprises:

at least one dielectric base;

a shell, the shell and the dielectric base being fixed to each other; and a pin set disposed on the dielectric base, wherein a second connector body is a connecting interface of an external device and adapted to be plugged to the first connector body through the opening, and the pin set is configured to connect the second connector body; and a mode-converting unit comprising:

a substrate fixed to the first connector body and having at least one circuit, wherein the substrate is a portion of the circuit board, and the circuit is connected to the signal transceiver module; and at least one mode-converting structure, the shell constituting at least one waveguide tube of the mode-converting unit and configured to transceive a signal, the circuit and the shell being coupled to each other through the mode-converting structure, and the signal being transmitted from the shell to the circuit through the mode-converting structure, or transmitted from the circuit to the shell through the mode-converting structure and emitted outward, wherein the signal is a millimeter-wave signal, and a section of an opening of the shell is related to a cut-off frequency of the shell.

30. The electronic device of claim 29, wherein the first connector body is a universal serial bus connecting interface or an audio connecting interface.

31. The electronic device of claim 29, further comprising a dielectric waveguide structure, wherein the dielectric waveguide structure is configured to be plugged to the first connector body through the opening, and the shell transceives the signal through the dielectric waveguide structure.

32. The electronic device of claim 31, wherein a conductive layer covers a portion of a surface of the dielectric waveguide structure.

33. The electronic device of claim 31, wherein an end of the dielectric waveguide structure is configured to be plugged to the first connector body, and another end of the dielectric waveguide structure has one or more bent portions.

34. The electronic device of claim 29, wherein the shell has a slot to constitute the mode-converting structure, and the slot is aligned to an end of the circuit.

35. The electronic device of claim 34, wherein the mode-converting unit further comprises a waveguide tube structure, a grounding plane of the substrate has another slot, the waveguide tube structure is connected between the slot of the shell and the another slot of the grounding plane, and the circuit is aligned to the another slot.

36. The electronic device of claim 29, wherein an end of the circuit has a probe structure to constitute the mode-converting structure, and the probe structure is adjacent to the shell.

37. The electronic device of claim 36, wherein the mode-converting unit further comprises a waveguide tube structure connected between the shell and the probe structure.

38. The electronic device of claim 29, wherein the shell has a closed end.

39. The electronic device of claim 29, wherein the shell constitutes one or more waveguide tube structures.

* * * * *